US007334614B2

(12) United States Patent
Cooper et al.

(10) Patent No.: US 7,334,614 B2
(45) Date of Patent: Feb. 26, 2008

(54) DEPTH ADJUSTMENT MECHANISM

(75) Inventors: Randy G. Cooper, Jackson, TN (US); Mark A. Etter, Humboldt, TN (US); Greg K. Griffin, Humboldt, TN (US); Ginger L. Allen, Jackson, TN (US); Derrick Kilbourne, Jackson, TN (US)

(73) Assignee: Black & Decker Inc., Newark, DE (US)

( * ) Notice: Subject to any disclaimer, the term of this patent is extended or adjusted under 35 U.S.C. 154(b) by 217 days.

(21) Appl. No.: 10/829,925

(22) Filed: Apr. 22, 2004

(65) Prior Publication Data

US 2006/0102248 A1 May 18, 2006

Related U.S. Application Data

(63) Continuation-in-part of application No. 10/686,300, filed on Oct. 15, 2003, now abandoned.

(60) Provisional application No. 60/467,169, filed on May 1, 2003, provisional application No. 60/418,510, filed on Oct. 15, 2002.

(51) Int. Cl.
*B27C 5/10* (2006.01)

(52) U.S. Cl. ..... 144/136.95; 409/182; 409/206

(58) Field of Classification Search ..... 144/136.95, 144/154.5, 286.1–287; 409/180–182, 206, 409/210, 218

See application file for complete search history.

(56) References Cited

U.S. PATENT DOCUMENTS

| | | | |
|---|---|---|---|
| 712,843 | A | 11/1902 | Paul |
| 1,370,895 | A | 3/1921 | Loomis |
| 1,514,894 | A | 11/1924 | Carter |
| 1,565,790 | A | 12/1925 | Carter |
| 1,584,078 | A | 5/1926 | Carter |
| 1,820,162 | A | 8/1931 | Salvat |

(Continued)

FOREIGN PATENT DOCUMENTS

| | | |
|---|---|---|
| CA | 500134 | 2/1954 |
| CA | 657748 | 2/1963 |
| CA | 2314653 | 7/2000 |
| GB | 712071 | 4/1952 |
| GB | 1037969 | 9/1965 |

(Continued)

OTHER PUBLICATIONS http://www.dremel.com/productdisplay/tool_template2.asp?SKU=9000-04&Color=99CCFF,#9000-04 Advantage Rotary Saw Kit, Mar. 21, 2003, 1 page.

(Continued)

*Primary Examiner*—Shelley M. Self
(74) *Attorney, Agent, or Firm*—Scott B. Markow

(57) ABSTRACT

A depth adjustment mechanism, disposed on a router, is enabled using a worm drive that includes a shaft member engaging with a rack member. The shaft member couples with a sleeve disposed on a base of the router. The rack member is coupled with a motor casing of the router. The depth adjustment mechanism enables a user selectable engagement of the shaft member with the rack member. A rotating member, which is coupled with the shaft member, is engaged by a user to displace the shaft member relative to the rack member. The selective engagement of the shaft member with the rack member and rotation enabled by the rotating member enables continuous metered depth adjustment for the router.

33 Claims, 33 Drawing Sheets

U.S. PATENT DOCUMENTS

| | | | | |
|---|---|---|---|---|
| 1,874,232 | A | 8/1932 | Groene et al. | |
| 2,353,202 | A | 7/1944 | Tautz | 144/134 |
| 2,425,245 | A | 8/1947 | Johnson | 121/36 |
| 2,504,880 | A | 4/1950 | Rittenhouse | 143/43 |
| 2,513,894 | A | 7/1950 | Rogers | 206/17 |
| 2,799,305 | A | 7/1957 | Groehn | 144/253 |
| 3,289,718 | A | 12/1966 | Willis | 144/136 |
| 3,436,090 | A | 4/1969 | Lange et al. | 280/11.37 |
| 3,443,479 | A | 5/1969 | Hawley et al. | 90/12 |
| 3,451,133 | A | 6/1969 | Hathaway et al. | 32/22 |
| 3,466,973 | A | 9/1969 | Rees | 90/12 |
| 3,481,453 | A | 12/1969 | Shreve, III et al. | 206/45.14 |
| 3,487,747 | A | 1/1970 | Burrows et al. | 90/11 |
| 3,494,395 | A | 2/1970 | Graham | 144/136 |
| 3,512,740 | A | 5/1970 | Podwalny | 248/154 |
| 3,587,387 | A | 6/1971 | Burrows et al. | 90/12 |
| 3,710,833 | A | 1/1973 | Hammer et al. | 144/134 A |
| 3,767,948 | A | 10/1973 | Batson | 310/50 |
| 3,791,260 | A | 2/1974 | Ambler et al. | 90/12 D |
| 3,827,820 | A | 8/1974 | Hoffman | 403/165 |
| 3,905,273 | A | 9/1975 | Shook | 90/11 R |
| 4,051,880 | A | 10/1977 | Hestily | 144/252 R |
| 4,085,552 | A | 4/1978 | Horine et al. | 51/166 R |
| 4,102,370 | A | 7/1978 | Vess | 144/134 D |
| 4,108,225 | A | 8/1978 | Hestily | 144/134 D |
| 4,143,691 | A | 3/1979 | Robinson | 144/134 D |
| 4,239,428 | A | 12/1980 | Berzina | 409/182 |
| 4,294,297 | A | 10/1981 | Kieffer | 144/134 D |
| 4,319,860 | A | 3/1982 | Beares | 409/182 |
| D267,492 | S | 1/1983 | Schieber | D5/141 |
| 4,410,022 | A | 10/1983 | Peterson | 144/1 F |
| 4,445,811 | A | 5/1984 | Sanders | 409/182 |
| 4,537,234 | A | 8/1985 | Onsrud | 144/134 A |
| 4,562,872 | A | 1/1986 | Fushiya et al. | 144/134 |
| 4,593,466 | A | 6/1986 | O'Brien | 30/272 A |
| D286,132 | S | 10/1986 | Yamamoto | D8/67 |
| 4,615,654 | A | 10/1986 | Shaw | 409/178 |
| 4,652,191 | A | 3/1987 | Bernier | 409/182 |
| 4,679,606 | A | 7/1987 | Bassett | 144/134 A |
| 4,718,468 | A | 1/1988 | Cowman | 144/134 D |
| 4,738,571 | A | 4/1988 | Olson et al. | 409/137 |
| 4,770,573 | A | 9/1988 | Monobe | 409/182 |
| D300,501 | S | 4/1989 | Zurwelle | D8/67 |
| 4,830,074 | A | 5/1989 | Lundblom | 144/251 B |
| RE33,045 | E | 9/1989 | Gronholz et al. | 144/134 |
| 4,872,550 | A | 10/1989 | Stranges | 206/315.1 |
| 4,924,571 | A | 5/1990 | Albertson | 30/121 |
| 4,938,642 | A | 7/1990 | Imahashi et al. | 409/182 |
| 5,012,582 | A | 5/1991 | Bristol et al. | 30/391 |
| 5,025,841 | A | 6/1991 | Totten | 144/134 R |
| 5,056,375 | A | 10/1991 | Kapton et al. | 74/89.15 |
| 5,062,460 | A | 11/1991 | DeLine | 144/136 |
| 5,074,724 | A | 12/1991 | McCracken | 409/182 |
| 5,078,557 | A | 1/1992 | McCracken | 409/182 |
| D323,935 | S | 2/1992 | Ward | D3/73 |
| 5,088,865 | A | 2/1992 | Beth et al. | 409/182 |
| 5,094,575 | A | 3/1992 | Keiser et al. | 409/182 |
| D326,597 | S | 6/1992 | Lee | D8/68 |
| 5,117,879 | A | 6/1992 | Payne | 144/1 F |
| 5,139,061 | A | 8/1992 | Neilson | 144/134 A |
| 5,181,813 | A | 1/1993 | McCracken | 409/182 |
| 5,188,492 | A | 2/1993 | McCracken | 409/182 |
| 5,191,621 | A | 3/1993 | Brok | 382/1 |
| D337,501 | S | 7/1993 | Witt | D8/70 |
| D340,174 | S | 10/1993 | Hoshino et al. | D8/67 |
| D341,305 | S | 11/1993 | Svetlik | D8/70 |
| 5,265,657 | A | 11/1993 | Matsumoto et al. | 144/134 D |
| 5,273,089 | A | 12/1993 | Fuchs et al. | 144/134 D |
| 5,289,861 | A | 3/1994 | Hedrick | 144/134 A |
| 5,308,201 | A | 5/1994 | Wilson et al. | 409/134 |
| D349,637 | S | 8/1994 | Hoshino et al. | D8/67 |
| 5,347,684 | A | 9/1994 | Jackson | 16/111 R |
| 5,353,474 | A | 10/1994 | Good et al. | 16/111 R |
| 5,353,852 | A | 10/1994 | Stolzer et al. | 144/134 D |
| 5,361,851 | A | 11/1994 | Fox | 173/170 |
| 5,368,424 | A | 11/1994 | Battenhausen | 409/182 |
| 5,429,235 | A | 7/1995 | Chen | 206/373 |
| 5,445,479 | A | 8/1995 | Hillinger | 408/16 |
| 5,452,751 | A | 9/1995 | Engler, III et al. | 144/1 F |
| 5,469,601 | A | 11/1995 | Jackson | 16/111 R |
| 5,511,445 | A | 4/1996 | Hildebrandt | 745/558.5 |
| 5,584,620 | A | 12/1996 | Blickhan et al. | 409/137 |
| 5,590,989 | A | 1/1997 | Mulvihill | 409/182 |
| 5,598,892 | A | 2/1997 | Fox | 173/170 |
| 5,613,813 | A | 3/1997 | Winchester et al. | 409/182 |
| 5,640,741 | A | 6/1997 | Yano | 16/114 R |
| 5,652,191 | A | 7/1997 | Patterson | 502/162 |
| 5,662,440 | A | 9/1997 | Kikuchi et al. | 409/182 |
| 5,671,789 | A | 9/1997 | Stolzer et al. | 144/154.5 |
| 5,678,965 | A | 10/1997 | Strick | 409/132 |
| 5,699,844 | A | 12/1997 | Witt | 144/329 |
| 5,725,036 | A | 3/1998 | Walter | 144/135.2 |
| 5,725,038 | A | 3/1998 | Tucker et al. | |
| 5,772,368 | A | 6/1998 | Posh | 409/182 |
| 5,803,684 | A | 9/1998 | Wang | 409/229 |
| 5,813,805 | A | 9/1998 | Kopras | 408/241 R |
| 5,829,931 | A | 11/1998 | Doumani | 409/132 |
| 5,853,273 | A | 12/1998 | Coffey | 409/182 |
| 5,853,274 | A | 12/1998 | Coffey et al. | 409/182 |
| 5,902,080 | A | 5/1999 | Kopras | 409/182 |
| 5,909,987 | A | 6/1999 | Coffey et al. | 409/131 |
| 5,913,645 | A | 6/1999 | Coffey | 409/182 |
| 5,918,652 | A | 7/1999 | Tucker | 144/371 |
| 5,921,730 | A | 7/1999 | Young et al. | 409/182 |
| D416,460 | S | 11/1999 | Bosten et al. | D8/67 |
| 5,988,241 | A | 11/1999 | Bosten et al. | 144/154.5 |
| 5,998,897 | A | 12/1999 | Bosten et al. | 310/89 |
| 6,050,759 | A | 4/2000 | Bone | 409/182 |
| 6,065,912 | A | 5/2000 | Bosten et al. | 409/134 |
| 6,079,915 | A | 6/2000 | Bosten et al. | 409/182 |
| 6,079,918 | A | 6/2000 | Buddendeck et al. | 409/182 |
| 6,182,723 | B1 | 2/2001 | Bosten et al. | 144/154.5 |
| 6,183,400 | B1 | 2/2001 | Pope | 482/92 |
| D444,364 | S | 7/2001 | Evans | D8/67 |
| 6,261,036 | B1 | 7/2001 | Bosten et al. | 409/182 |
| 6,266,850 | B1 | 7/2001 | Williams et al. | 16/430 |
| 6,289,952 | B1 | 9/2001 | Jones et al. | 144/135.2 |
| 6,305,447 | B1 | 10/2001 | Rousseau | 144/135.2 |
| 6,318,936 | B1 | 11/2001 | McFarlin, Jr. et al. | 409/131 |
| 6,419,429 | B1 | 7/2002 | Long et al. | 409/182 |
| 6,443,675 | B1 | 9/2002 | Kopras et al. | 409/182 |
| 6,443,676 | B1 | 9/2002 | Kopras | 409/182 |
| 6,474,378 | B1 | 11/2002 | Ryan et al. | 144/154.5 |
| 6,505,659 | B1 | 1/2003 | Hummel | 144/135.2 |
| 6,520,224 | B2 | 2/2003 | Smith | 144/135.2 |
| 6,520,227 | B2 | 2/2003 | McFarlin, Jr. et al. | 144/371 |
| D473,439 | S | 4/2003 | Grant et al. | D8/61 |
| 6,550,154 | B1 | 4/2003 | Smith | 33/638 |
| 6,725,892 | B2 | 4/2004 | McDonald et al. | 144/136.95 |
| 6,726,414 | B2 | 4/2004 | Pientka et al. | 409/182 |
| 6,739,066 | B2 | 5/2004 | Smith | 33/638 |
| 6,779,954 | B2 | 8/2004 | Tomayko | 409/182 |
| 6,792,984 | B2 | 9/2004 | Fontaine | 144/135.2 |
| 2002/0020466 | A1 | 2/2002 | McFarlin, Jr. et al. | 144/135.2 |
| 2002/0043294 | A1 | 4/2002 | McDonald et al. | 144/154.5 |
| 2002/0079021 | A1 | 6/2002 | Smith | 144/135.2 |
| 2003/0188441 | A1 | 10/2003 | Patton | 30/381 |
| 2003/0205292 | A1 | 11/2003 | Smith | 144/252.1 |
| 2003/0223835 | A1 | 12/2003 | Hummel | 409/182 |

| | | | | |
|---|---|---|---|---|
| 2004/0035495 | A1 | 2/2004 | Hessenberger et al. | 144/136.95 |
| 2004/0194854 | A1 | 10/2004 | McDonald et al. | 144/136.95 |
| 2004/0200543 | A1 | 10/2004 | McDonald et al. | 144/136.95 |
| 2004/0250891 | A1 | 12/2004 | McDonald et al. | 144/136.95 |
| 2004/0253068 | A1 | 12/2004 | Gerhardt et al. | 409/182 |

FOREIGN PATENT DOCUMENTS

| | | |
|---|---|---|
| JP | 54051247 | 4/1979 |
| JP | 04297645 | 10/1992 |
| JP | 04297646 | 10/1992 |
| JP | 06136286 | 5/1994 |
| JP | 06164544 | 6/1994 |

OTHER PUBLICATIONS

Bosch 1617 Shop Router, Parts Diagram, Jul. 1998.

Bosch Router Models, Owners Manual, p. 1-22, http//www.boschtools.com.

Triton TRC-001 Router Woodworking Pat Warner 2003.

Triton TRC-001 3.25hp Plunge Router a review by Bill Esposito Jan. 2003.

Triton 3¼hp Plunge Router Review.

Triton ½" Precision Router (TRA001).

DEPTH ADJUSTMENT MECHANISM

CROSS REFERENCE TO RELATED APPLICATION

The present invention is claims priority under 35 U.S.C. §120 as a continuation-in-part of the U.S. application Ser. No. 10/686,300, filed on Oct. 15, 2003 now abandoned, which claims priority under 35 U.S.C. §119(e) to the U.S. Provisional Application Ser. No. 60/418,510, filed on Oct. 15, 2002, and the U.S. Povisional Application Ser. No. 60/467,169, filed May 1, 2003. The U.S. application Ser. No. 10/686,300 and both U.S. Provisional Applications 60/418,510 and 60/467,169 are herein incorporated by reference in their entireties.

FIELD OF THE INVENTION

The present invention generally relates to the field of power tools, and particularly to a depth adjustment mechanism for a power tool, such as a router, biscuit joiner, planers, and the like.

BACKGROUND OF THE INVENTION

Routers are employed to accomplish a variety of tasks. Used for shaping objects typically composed of wood, plastic, metal, composite materials, and the like, routers have become a mainstay of the construction work site and home work shops. Controlling the router while in operation has been the purview of many design configurations. The depth of cut provided by a router has been the focus of many different design configurations, from handles which can operably change the depth, to attachments which may be employed to adjust the depth, to base designs which allow an operator to vary cut depth. Unfortunately, the typical designs have required the use of non-integrated parts to accomplish these depth adjustments.

The adjustment mechanisms employed currently may also be limited by their ability to achieve satisfactory results. For instance, some adjustment mechanisms may be enabled to satisfactorily achieve coarse adjustments, allowing the operator to make significant changes in the depth of cut to be achieved, but fail to provide a satisfactory ability to fine adjust the depth of cut. Alternatively, adjustment mechanisms designed to provide fine adjustments may have overly burdensome mechanisms. For example, some current depth adjustment mechanisms may provide a limited number of predetermined stops which limit the flexibility of cut depth. Other current depth adjustment mechanisms may employ multiple stage depth adjust systems where the operator is required to adjust through the range of depth adjustment provided by one stage before being required to engage a secondary stage to make further adjustments.

It is common to see operators of routers being forced to employ external devices into designated regions of the router in order to achieve depth adjustment functionality. This design feature being based on the assumption that totally integrating a depth adjustment mechanism into a router would make the router too large, uncontrollable, or aesthetically displeasing.

Therefore, it would be desirable to provide an aesthetically pleasing router which was enabled with a continuous metered depth adjusting functionality, increasing an operator's ability to make both coarse and fine adjustments, without requiring the use of external devices.

SUMMARY OF THE INVENTION

Accordingly, the present invention is directed to a depth adjustment mechanism which may be employed with a router. The depth adjustment mechanism may permit continuous metered depth adjustment. This functionality may be enabled by a variety of mechanisms such as a worm drive assembly mounted parallel to a cylindrical portion of a motor casing of the router. The threading of the worm drive may mesh with threadings spaced longitudinally along the motor casing generally opposite the worm drive. A handle may be connected to the worm drive for rotating the drive and a micro adjust collar with depth adjustment indications. Such a depth adjustment mechanism may provide significant advantages over current systems for depth adjustment being employed in many routers. For example, by not requiring external devices for making the adjustments there is no risk of misplacement of necessary components resulting in inoperability of the depth adjustment system. Further, the present invention, may provide an easier method of adjustment thereby reducing fatigue and stress on the operator and thus prolonging use of the router.

Additionally, the present invention may be operated from the base end through mechanical connection with the worm drive. Such a system may be advantageous when the router is being employed with a router table. In such an instance the present invention may be provided with an extendable spindle and collet which facilitate bit changes by extending beyond a base or sub-base.

It is an object of the present invention to provide a router which increases the ease by which an operator may adjust the depth of cut performed by an operator of the router during operation of the router. It is a further object of the present invention to provide a depth adjustment mechanism which may be easily accessed by an operator when the router is being employed with other equipment, such as a router table. It is a still further object of the present invention, to facilitate easy replacement of bits in the router.

A method of providing continuous metered depth adjustments of a router bit is provided by the present invention. Through the use of a router, engaged with the router bit, including a depth adjustment mechanism of the present invention a user is provided the ability to make continuous metered depth adjustments to the depth of cut established by the router bit.

It is to be understood that both the forgoing general description and the following detailed description are exemplary and explanatory only and are not restrictive of the invention as claimed. The accompanying drawings, which are incorporated in and constitute a part of the specification, illustrate exemplary embodiments of the invention and together with the general description, serve to explain the principles of the invention.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

Figure 1:
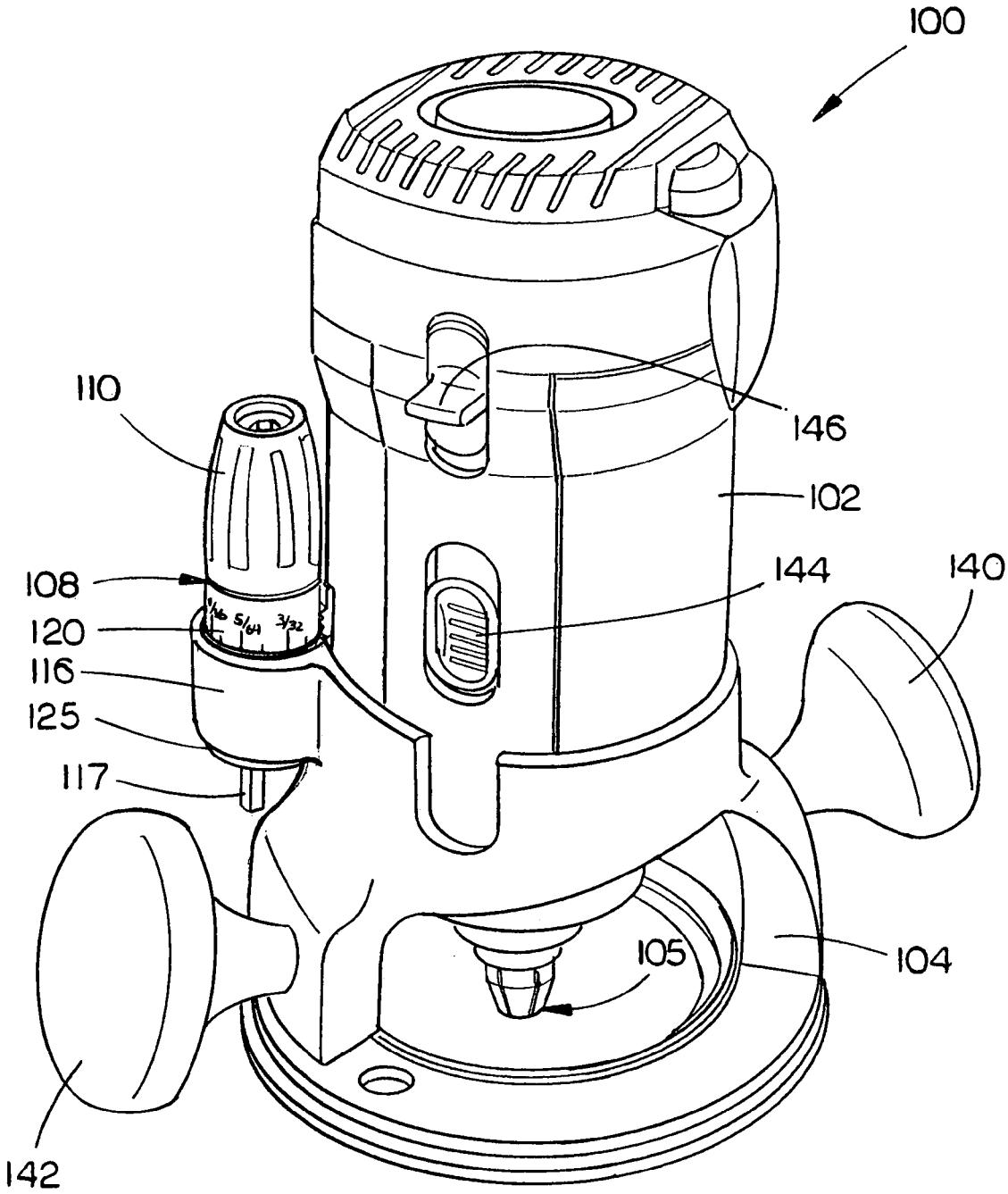
FIG. 1 is an isometric view illustrating a router assembly including a depth adjustment mechanism in accordance with an exemplary embodiment of the present invention.
Figure 2:
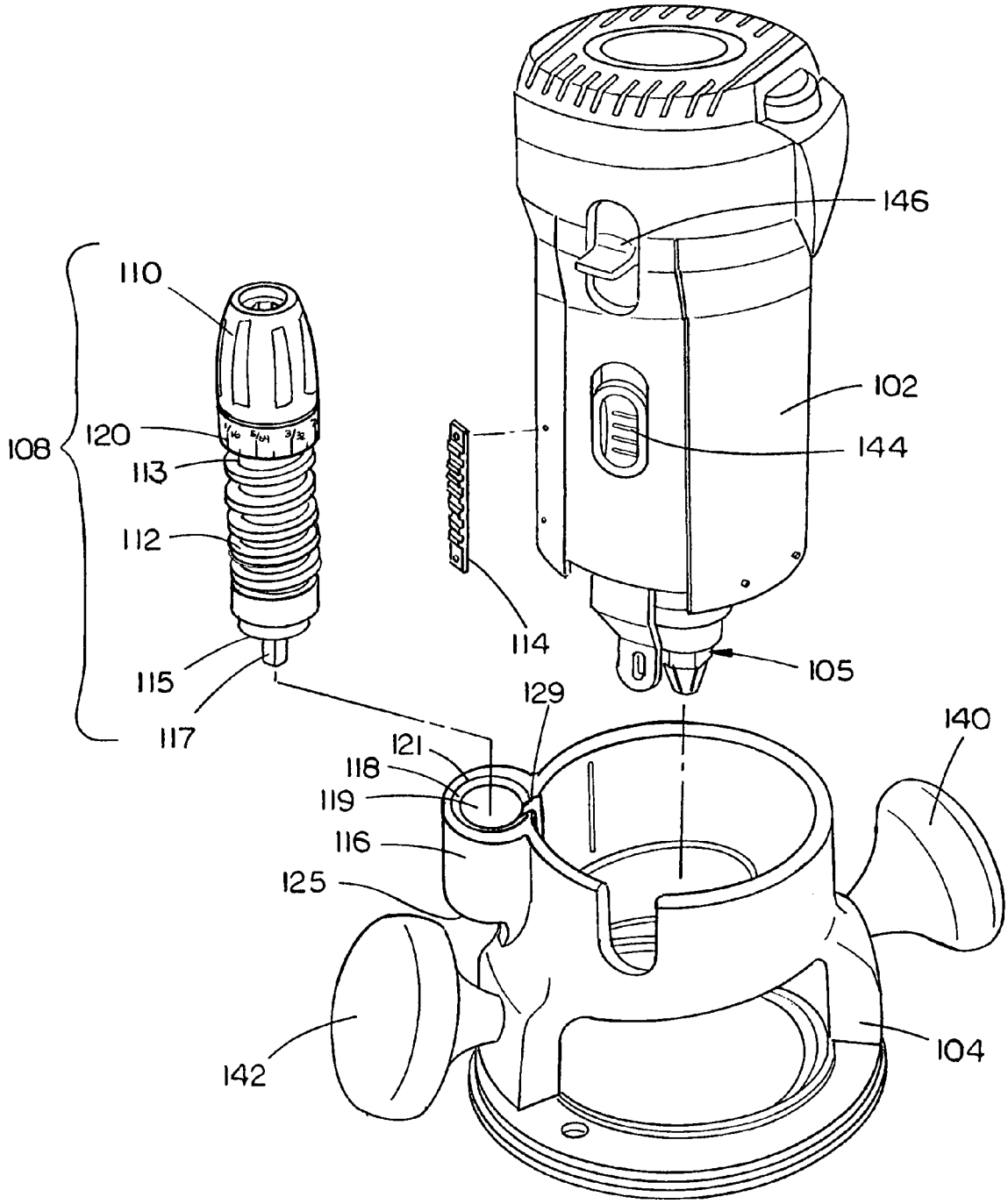
FIG. 2 is an exploded view of the depth adjustment mechanism of the router assembly of FIG. 1.
Figure 3:
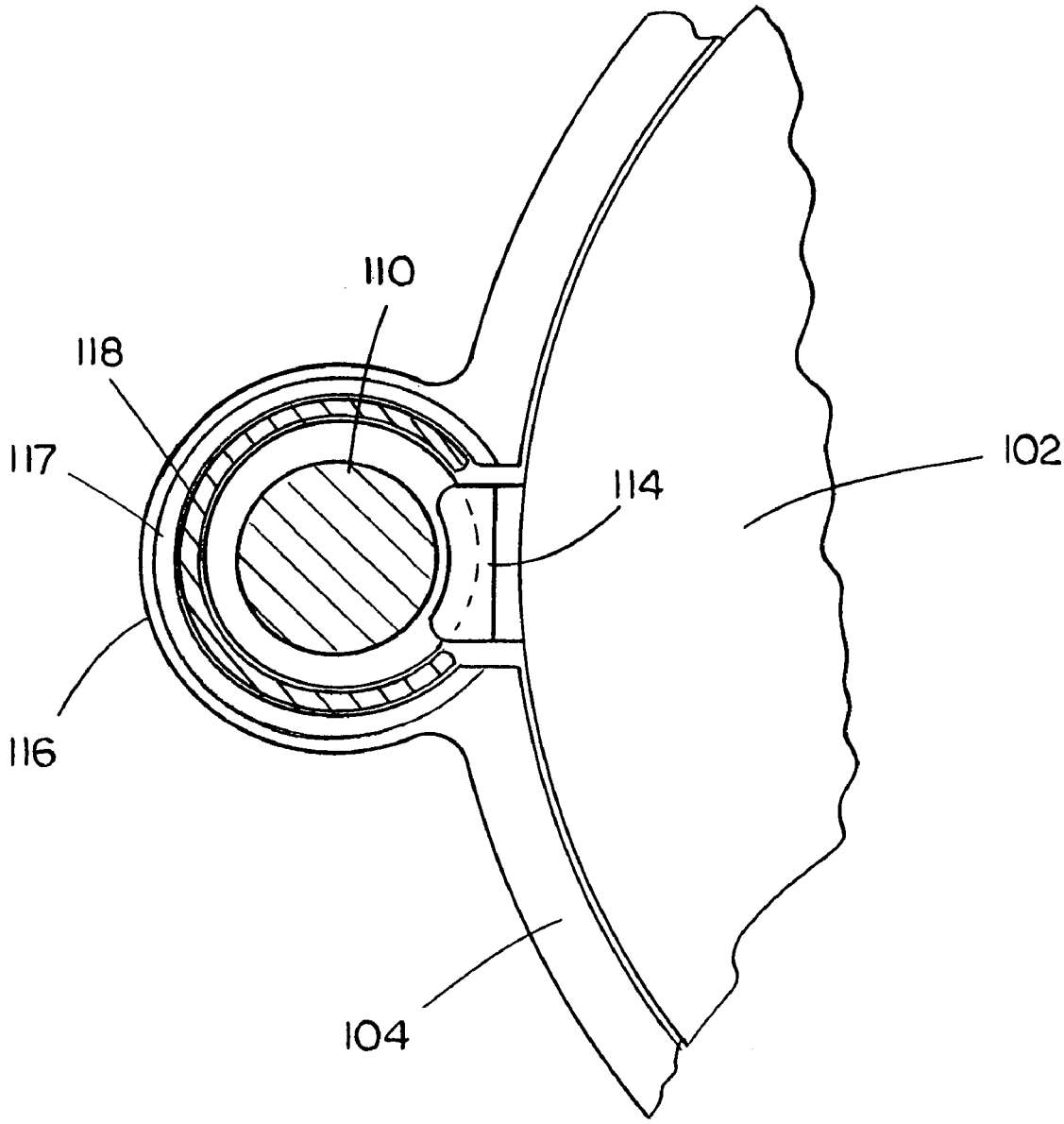
FIG. 3 is a top plan view illustrating the adjustable coupling capability of the depth adjustment mechanism of the router assembly of FIG. 1 for engaging a shaft member against a rack member.

Reference will now be made in detail to the presently preferred embodiments of the invention, examples of which are illustrated in the accompanying drawings, FIGS. 1 through 34.

Referring generally now to FIGS. 1 through 4, a first exemplary embodiment of a router assembly 100 including a motor casing 102 adjustably coupled with a base 104 and a depth adjustment mechanism, is shown. The motor casing 102 is disposed with a motor operationally coupled with a spindle and collet assembly 105 which may operationally couple a router bit. The depth adjustment mechanism is enabled as a worm drive assembly comprising a handle 108 including a rotating member 110 which is operationally coupled with a shaft member 112. In the current embodiment, the shaft member 112 is a shaft member. Various other configurations of the shaft member 112 may be employed without departing from the scope and spirit of the present invention. A first end 113 of the shaft member 112 couples with the rotating member 110 and a second end 115 of the shaft member 112 includes a mechanical connector 117.

A rack member 114 is disposed on the motor casing 102 and is for engaging with the shaft member 112. In the current embodiment the rack member is a spirally threaded rack member 114 for engaging with the shaft member 112. The configuration of the rack member 114 may be varied to accommodate the configuration of the shaft member 112 and enable the functionality of the depth adjustment mechanism. It is contemplated that the rack member 114 may be removed form the motor casing 102, enabling retro-fitting of the rack member 114 with a secondary motor casing assembly or retro-fitting of the motor casing 102 with a secondary rack member.

The depth adjustment mechanism enabled as a worm drive assembly will be generally shown and described throughout the instant application. The various component features will be shown as having generally similar configurations and functionality. It is understood that the various embodiments may vary the configuration of the components of the depth adjustment mechanism to provide similar functionality as contemplated by those of ordinary skill in the art. It is the intention of the following description to encompass such varying configurations.

The handle 108 is received within a sleeve 116 disposed upon the base 104. In a preferred embodiment, the sleeve defines a cylindrical recessed area including a defined recessed area 119 which extends from a first end 121 to a second end 125 of the sleeve 116. The defined recessed area is for receiving the handle 108 into the sleeve 116. It is understood that the defined recessed area 119 establishes an aperture defined by the first end 121 and extending through the sleeve 116 to an aperture defined by the second end 125. Alternatively, the second end 125 may include a cover which at least partially encloses the cylindrical recessed area of the sleeve 116. In a preferred embodiment, the sleeve 116 includes a feeder 118, said feeder 118 is engaged by the handle 108 as it is being operationally inserted within the sleeve 116. The sleeve 116 further defines an access point 129, which is operationally disposed within the base 104. The access point 129 is preferably a slot within the base 104 in which the rack member 114 is operationally enabled to couple with the shaft member 112. The configuration of the access point 129 may be varied as contemplated by those of ordinary skill in the art.

Advantageously, the depth adjustment mechanism of the present invention enables a user to make macro adjustments. The macro adjustments may be accomplished through releasing the operational engagement of the shaft member 112 with the rack member 114. This may occur when the handle 108 is removed from the sleeve 116 or partially disposed within the sleeve 116, positioned away from the motor casing 102. When the depth adjustment mechanism is so established the user may manually alter the position of the motor casing 102 relative to the base 104. The rotating member 110 may be rotated in either a clockwise or counter-clockwise direction in order to provide micro adjustments of the positioning of the router bit.

Figure 4:
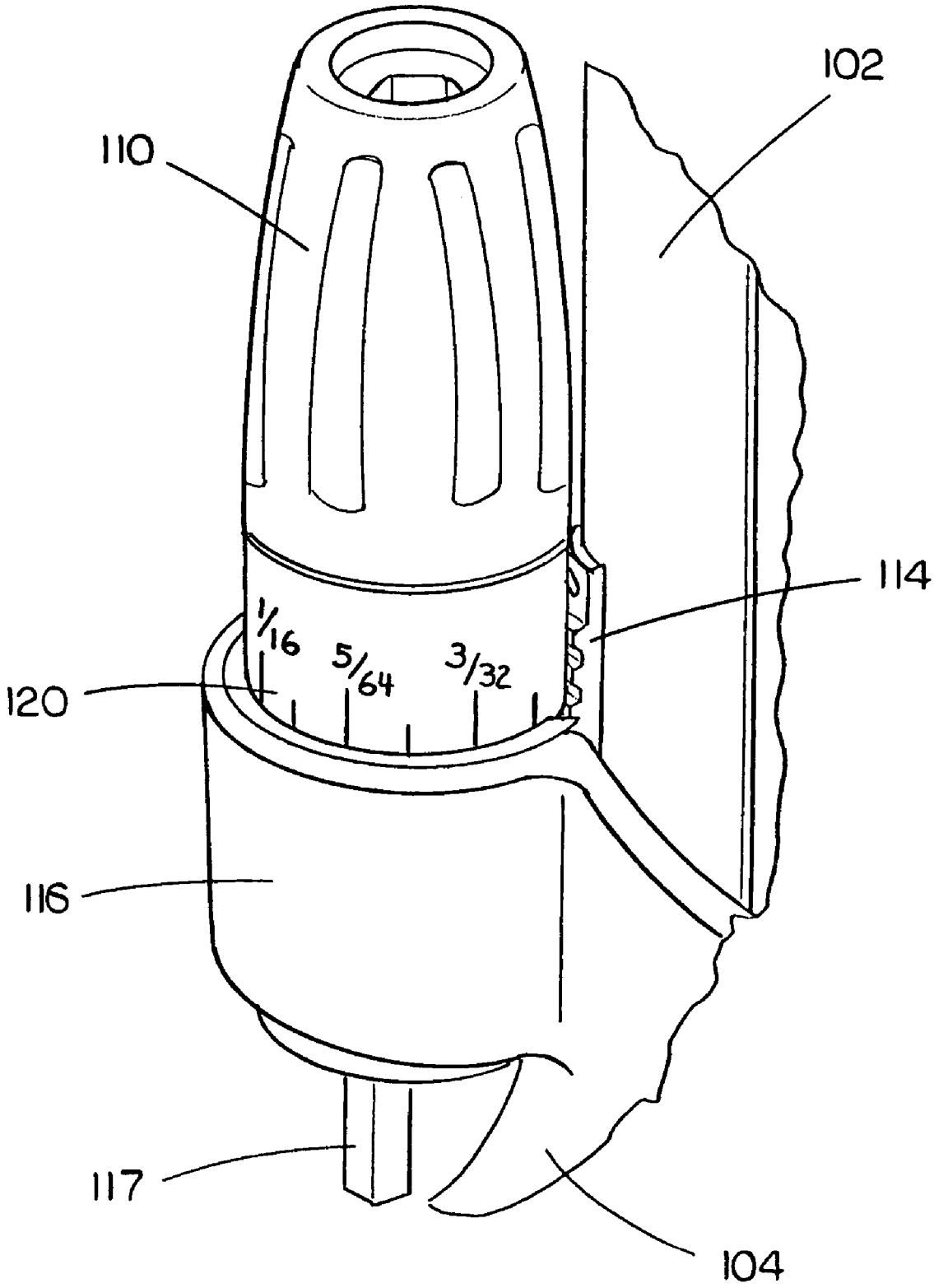
FIG. 4 is an illustration of the depth adjustment mechanism of FIG. 1, including a micro adjust collar coupled with a handle.
Figure 5:
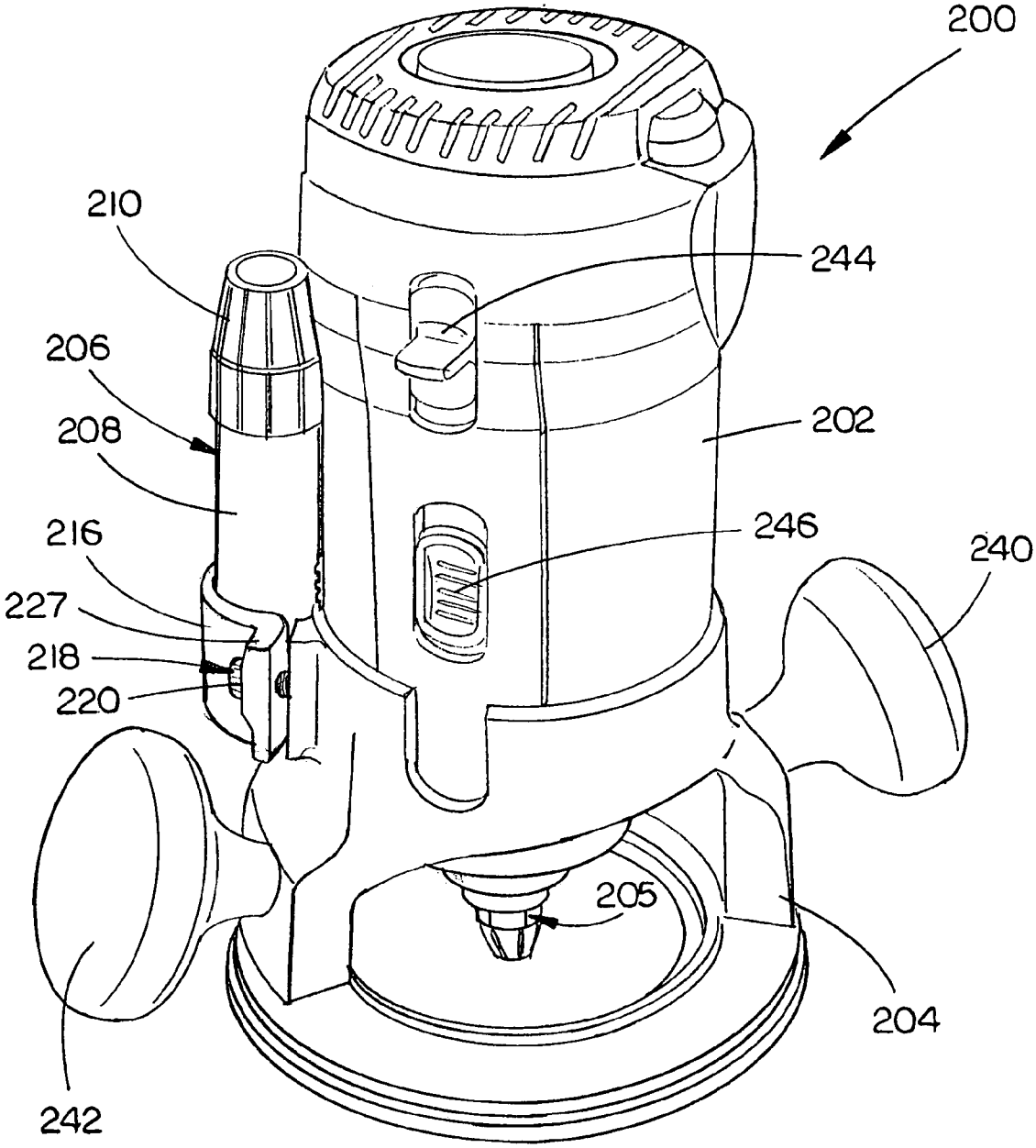
FIG. 5 is an isometric view illustrating a second exemplary embodiment of a router assembly including a depth adjustment mechanism enabled via a worm drive assembly in accordance with the present invention.
Figure 6:
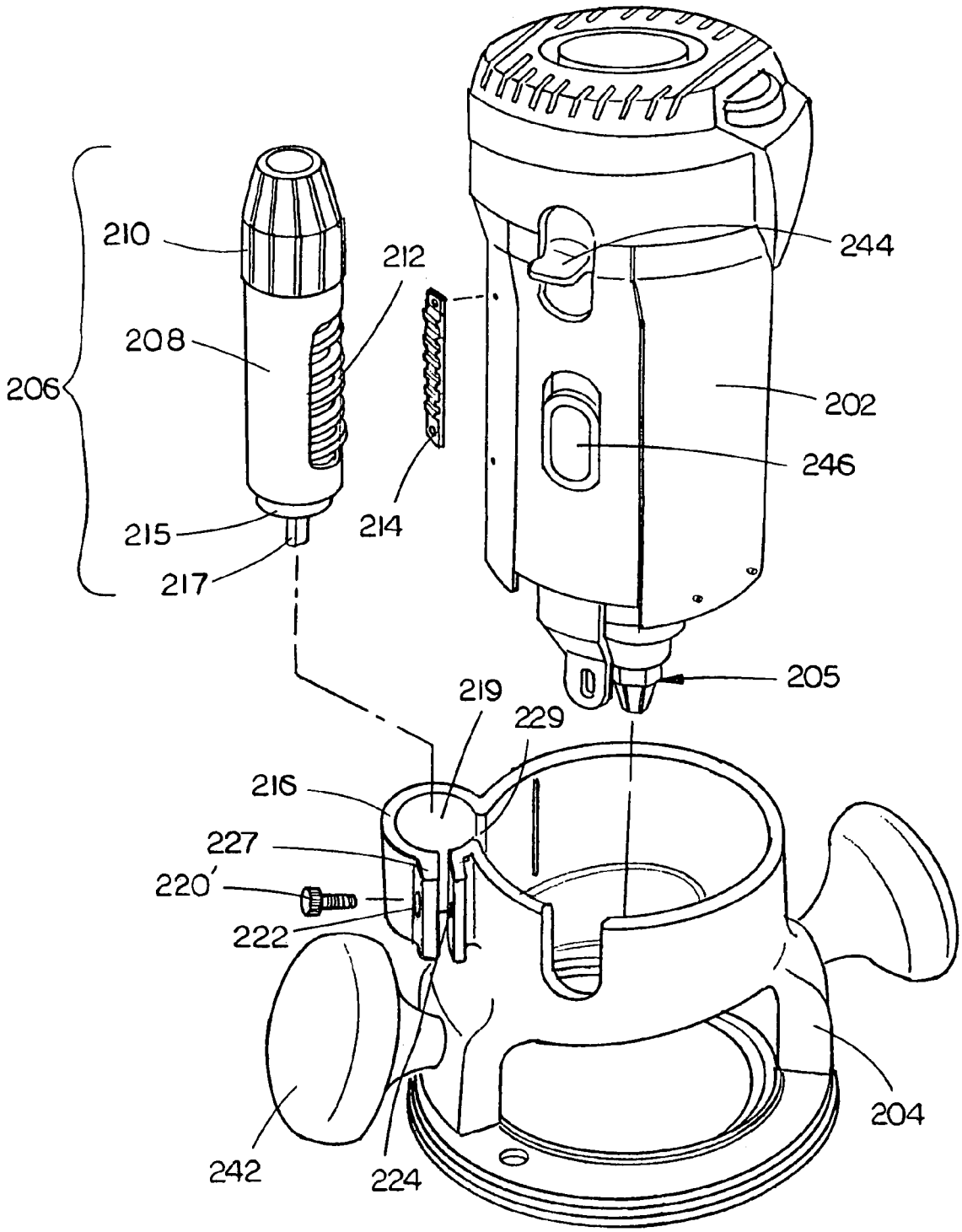
FIG. 6 is an exploded view of the router assembly and the depth adjustment mechanism of FIG. 5.
Figure 7:
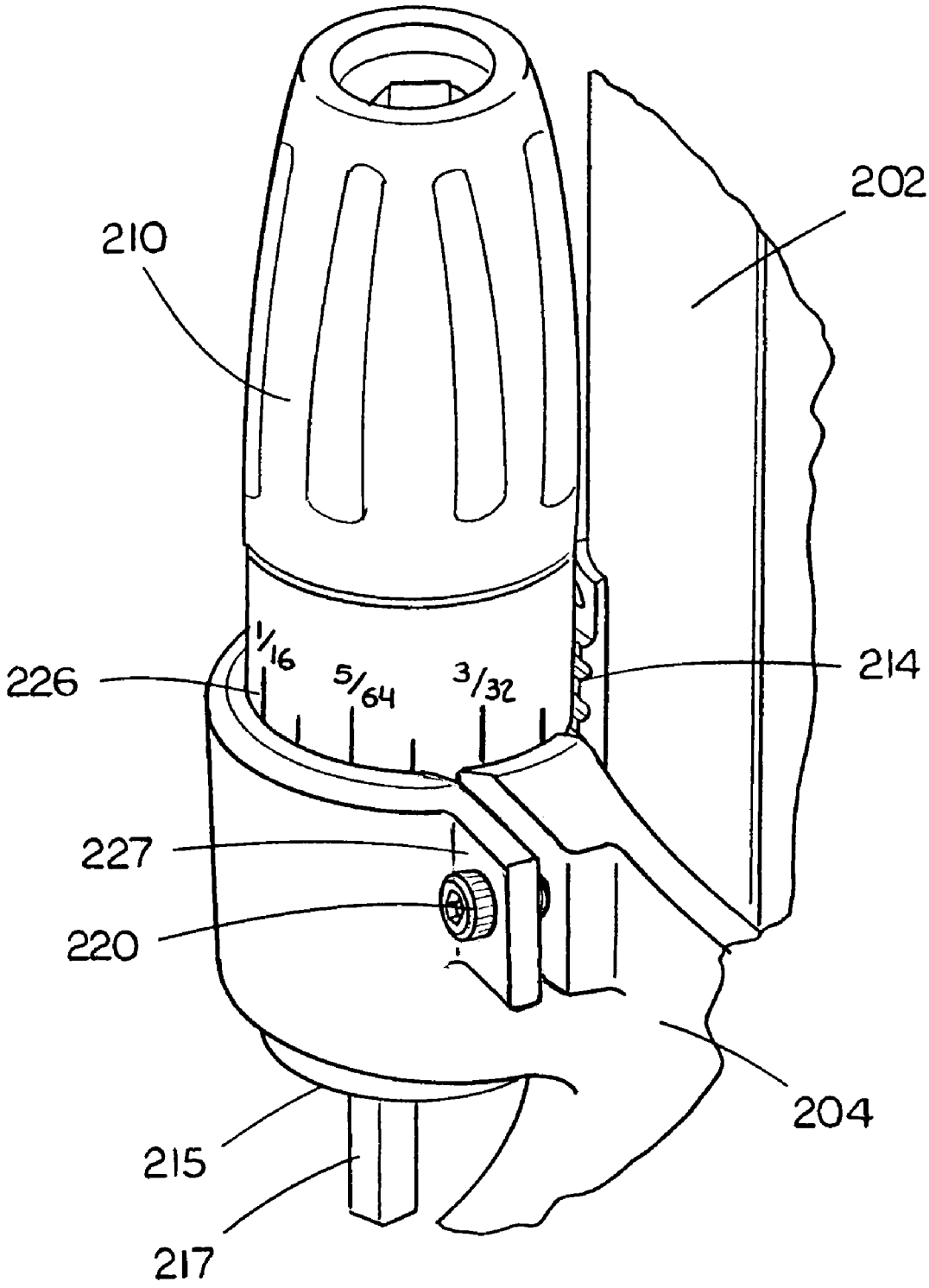
FIG. 7 is an illustration of the depth adjustment mechanism of FIG. 5, including a micro adjust collar coupled with a handle.
Figure 8:
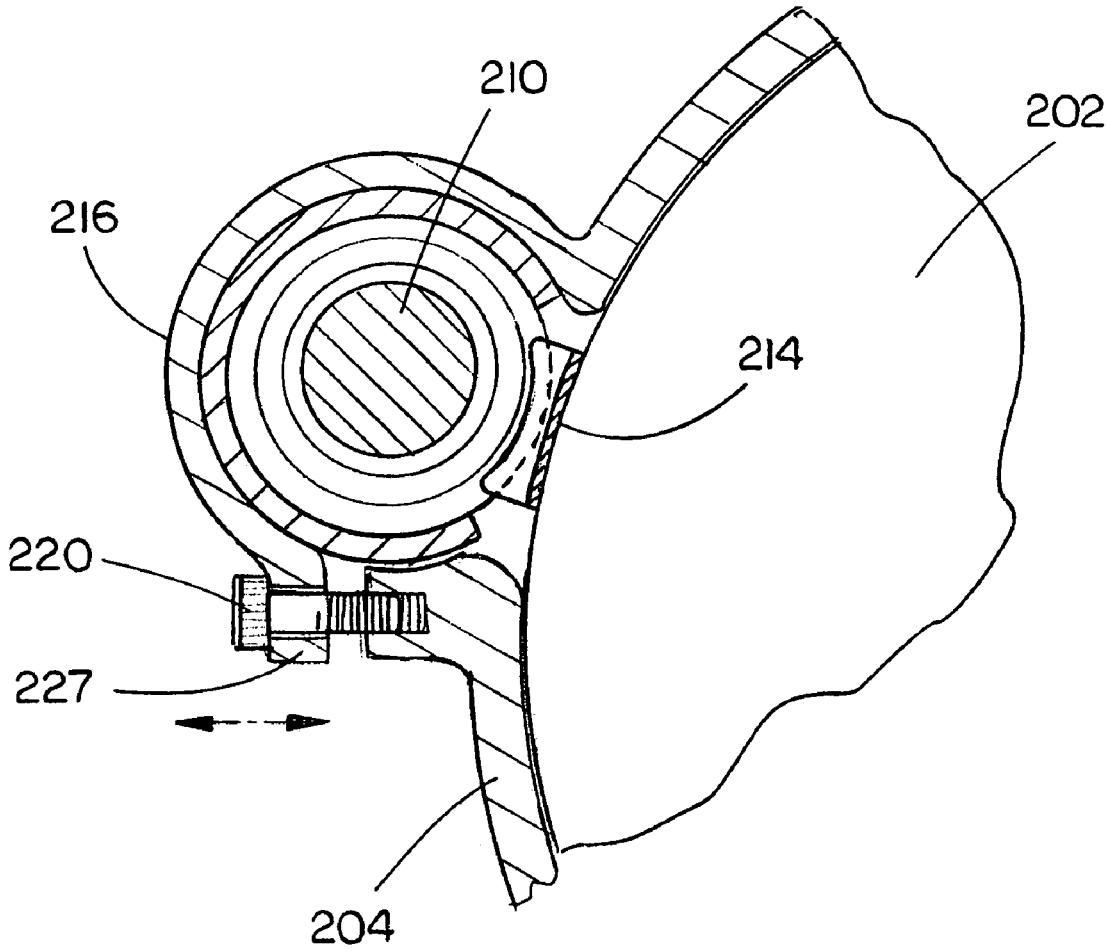
FIG. 8 is a top plan perspective view illustrating the depth adjustment mechanism of FIG. 5 and indicating the selective movement capabilities enabled by a fastening assembly and the corresponding selective engagement capabilities of a shaft member with a rack member of the worm drive assembly.
Figure 9:
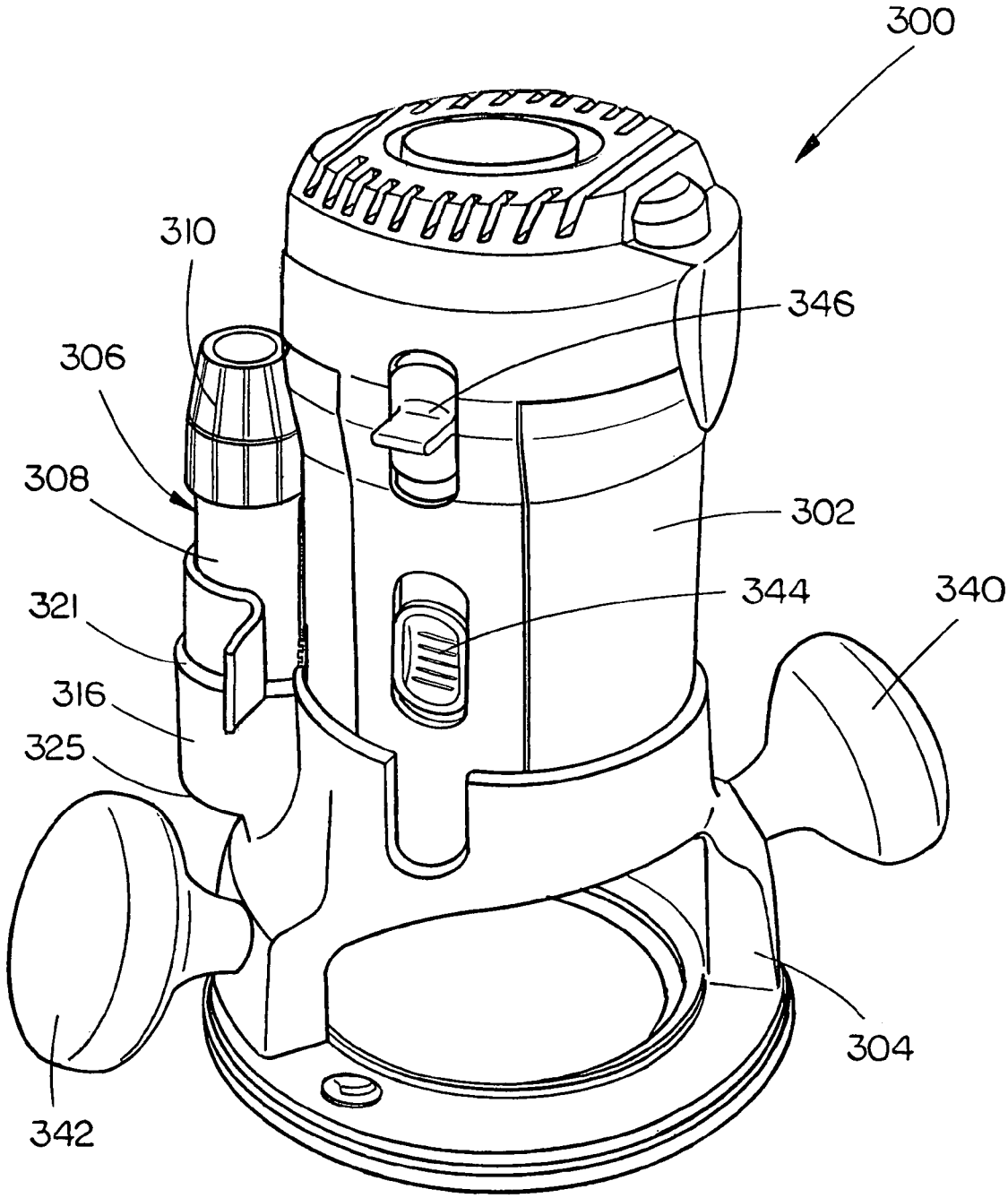
FIG. 9 is an isometric view illustrating a third exemplary embodiment of a router assembly including a depth adjustment mechanism enabled via a worm drive assembly including a housing engaged by a first exemplary embodiment of a biasing assembly in accordance with the present invention.
Figure 10:
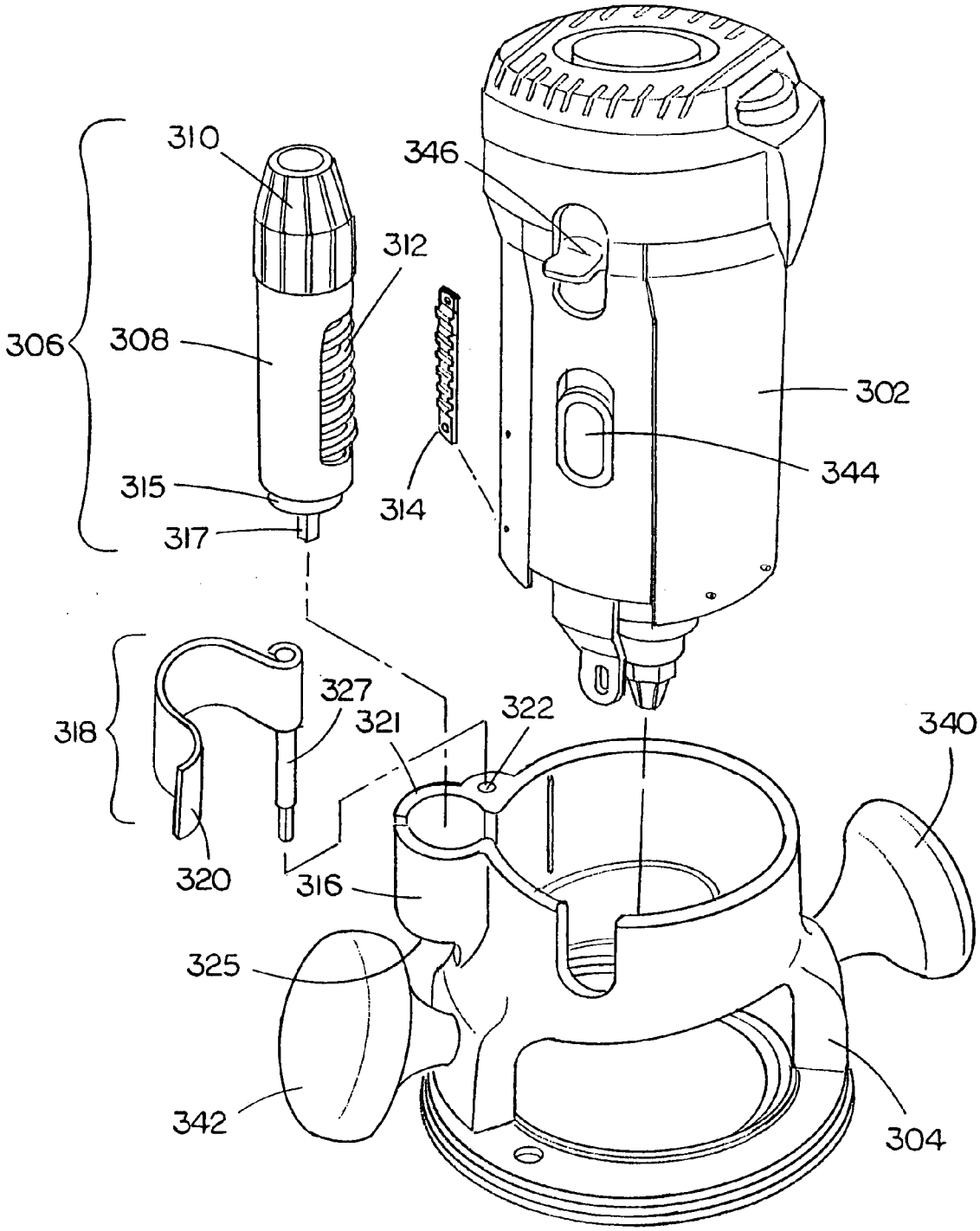
FIG. 10 is an exploded view of the router assembly including the depth adjustment mechanism of FIG. 9.
Figure 11:
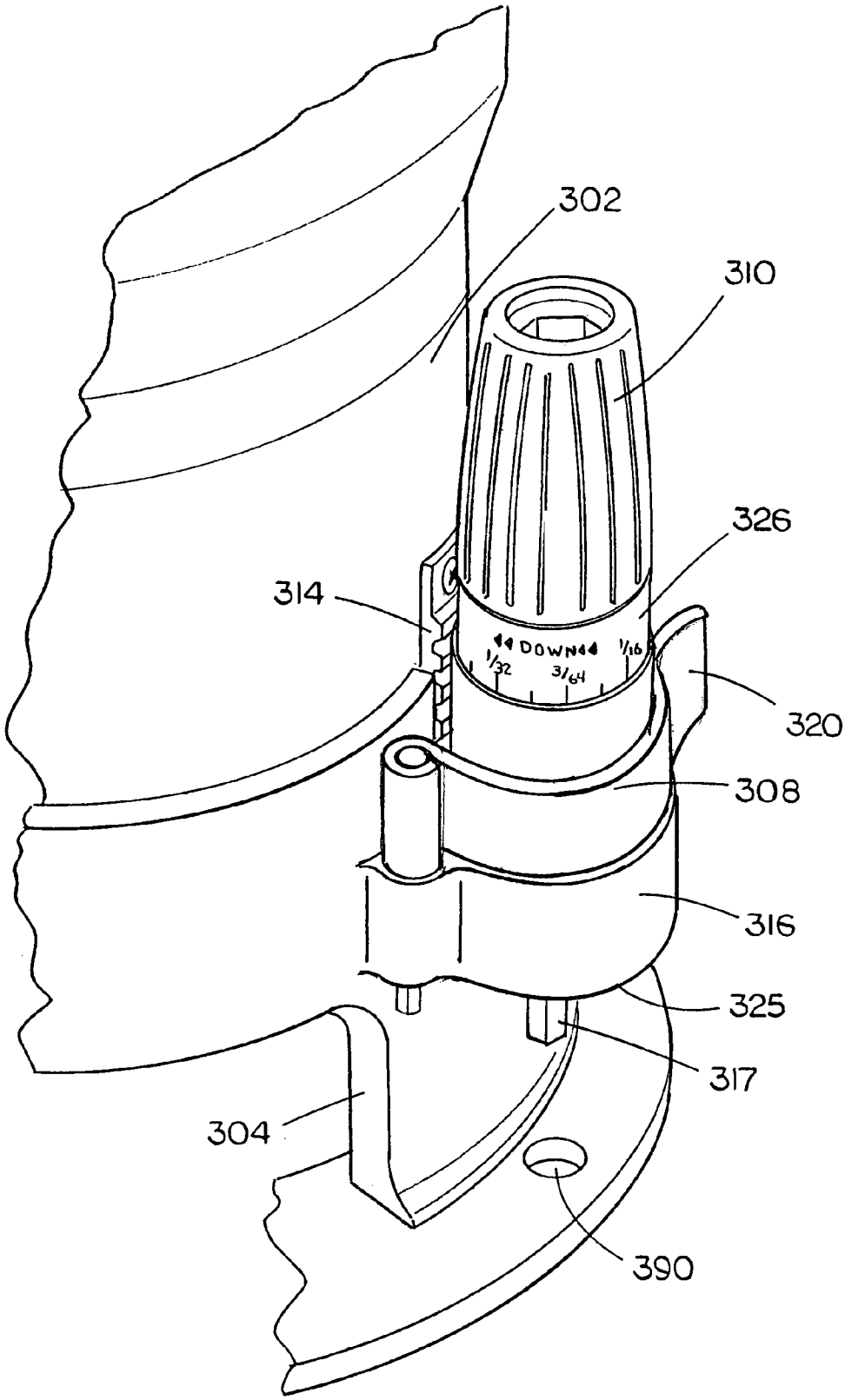
FIG. 11 is an illustration of the depth adjustment mechanism of FIG. 9, including a micro adjust collar coupled with a handle.

Further, a micro adjust collar 120, as shown in FIG. 4, may be operationally coupled with the handle 108, rotating member 110 and the first end 113 of the shaft member 112. The micro adjust collar 120 provides the operator a visual indication of the depth enabled by a turn of the rotating member 110. The micro adjust collar 120 may include hash marks relating to depth, as shown in a preferred embodiment. It is contemplated that other methods of indicating depth may be employed without departing from the scope and spirit of the present invention. The micro adjust collar 120 preferably provides indications of depth in a three hundred sixty degree orientation around the handle 104. It is contemplated that the micro adjust collar 120 may provide indication of depth in a one hundred eighty degree arc or in various other degree of arc configurations as may be contemplated by one of ordinary skill in the art. As stated above, the micro adjust collar 120 may advantageously enable a user to establish the range of fine adjustment enabled by a rotation of the rotating member 110, which in-turn establishes the position of the router bit by adjusting the position of the motor casing 102 relative to the base 104. For example, the micro adjust collar 120 may be set by the user to enable a one half inch adjustment for each rotation of the rotating member 110. It is contemplated that the micro adjust collar 120 may provide various depth adjustment capabilities, ranging from one-sixteenth of an inch to one and one-half inch of adjustment per turn of the handle. Thus, the depth adjustment mechanism is enabled as a continuous worm drive assembly which enables a user to make continuous metered macro and/or micro adjustments of the position of the router bit.

In operation, the worm gear assembly is engaged when the shaft member 112 is engaged against the rack member 114 disposed upon the motor casing 102. This occurs when the handle 108, including the rotating member 110 and the shaft member 112, is operationally inserted within the sleeve 116. When the handle 108 is being first inserted into the sleeve 116 the handle 108 is positioned away from the motor casing 102. As the handle 108 is further inserted into the sleeve 116 it engages against the feeder 118. The feeder 118 provides for the movement of the handle 108 towards the motor casing 102 as the handle 108 is further inserted into the sleeve 116. Upon the full insertion of the handle 108 into the sleeve 116, the feeder 118 has enabled the positioning of the handle 108 in operational contact with the motor casing 102. The operational contact of the handle 108 with the motor casing 102 is established when the spirally threaded member 112, coupled with the handle 108, is engaged against the rack member 114, disposed on the motor casing 102. It is understood that the feeder 118 may be variously configured as contemplated by those of ordinary skill in the relevant art. Further, the enablement of positioning the handle 108 within the sleeve 116 for operation of the worm drive gearing may be accomplished in various manners without departing from the scope and spirit of the present invention.

It is contemplated that the positioning of the handle 108, inserted within the sleeve 116 and operationally engaging with the motor casing 102, may be secured through the use of a fastening assembly. The fastening assembly may be of various configurations, such as a latch assembly, compression lock assembly, snap assembly, spring-loaded assembly, and the like. Further, the component features of the fastening assembly may be disposed upon various components of the depth adjustment mechanism. For example, the handle 108 may include a receiver which may be operationally engaged by a latch disposed on the feeder 118. Alternatively, the latch may be disposed in various locations about the sleeve 116. In alternative embodiments, the spirally threaded shaft 112 may include a compression lock which may affix with a receiver disposed within the sleeve 116. It is further contemplated that implementation of the aforementioned fastening assemblies may include release mechanisms. These mechanisms may be manually engaged by the operator or provide release of the handle 108 through a re-positioning of the handle 108.

It is further contemplated that the handle 108 may be enabled in various positions while received within the sleeve 116. This enablement may be provided by various mechanisms as contemplated by those of ordinary skill in the art. For example, a spring-loaded elbow assembly may be coupled with the shaft member 112 and enable the adjustment of the handle 108 relative to the sleeve 116. The feeder 118 may include a mechanism for enabling the re-positioning of the handle 108 without requiring the handle 108 to be removed from the sleeve 116.

The mechanical connector 117 of the shaft member 112 extends to enable operational access to the depth adjustment mechanism. For instance, the router assembly 100 may be coupled with a router table assembly. The router assembly 100 may couple on the underside of a table of the router table assembly. The table may include a through point which allows a device, such as a key, to insert through the table and engage with the mechanical connector 117 of the shaft member 112. Access of the tool to the mechanical connector 117 may be provided by a base access point (i.e., an aperture) defined in the base 104. Alternative configurations for the base access point, as contemplated by those of ordinary skill in the art, may be employed. Thus, a user may adjust the depth of the router bit, relative to the table, by rotating the key. It is understood that various configurations of the router table assembly and the shaft member 112 may be employed without departing from the scope and spirit of the present invention.

In this preferred embodiment, the base 104 is further disposed with a first knob handle 140 and a second knob handle 142. The first and second knob handles may be removable from the base assembly. It is further understood that the knob handles may be replaced with a variety of handle apparatus, such as a post, an "L" shaped handle, and the like. The motor casing assembly 102 further includes a first selector 144 and a second selector 146. The first and second selectors may be used to operate the router assembly 100 by enabling an operator to provide power to a motor disposed within the motor casing 102. Power may be provided through a standard electrical cord, a battery assembly (including re-chargeable batteries), and the like without departing from the scope and spirit of the present invention.

Referring generally now to FIGS. 5 through 8, a second exemplary router assembly 200 comprising a motor casing 202 adjustably coupled with a base assembly 204 and a second exemplary depth adjustment mechanism, is shown. The motor casing 202 is disposed with a motor operationally engaging a collet assembly 205 which may operationally engage a router bit. The depth adjustment mechanism is enabled as a continuous worm drive assembly comprising a handle 206 including a housing 208 adjustably coupled with a rotating member 210 which is operationally coupled with a shaft member 212. A first end of the shaft member 212 couples with the rotating member 210 and a second end 215 of the shaft member 212 includes a mechanical connector 217. Additionally, the worm gear of the depth adjustment mechanism includes a rack member 214 disposed upon the motor casing assembly 202.

A micro adjust collar 226, similar to the micro adjust collar 120, may be operationally coupled with the housing 208, rotating member 210 and the shaft member 212. The micro adjust collar 226 enables the continuous metered fine "micro" adjustment capability of the position of the router bit. As described previously, continuous metered macro adjustments may also be enabled through the present invention.

The housing 208 may be received within a sleeve 216 disposed upon the base assembly 204. The sleeve 216 defines an at least partially enclosed recessed area within which the housing 208 may be inserted, similar to the defined recessed area 119 described above in reference to FIGS. 1 through 4. In a preferred embodiment, the sleeve defines a cylindrical recessed area 219, extending from a first end 221 to a second end 225, for receiving the housing 208. The defined recessed area is for receiving the handle 208 into the sleeve 216. Alternatively, the second end 225 may include, a cover which, at least partially encloses the cylindrical recessed area of the sleeve 216. In a preferred embodiment, the sleeve 216 includes a feeder, said feeder is engaged by the handle 206 as it is being operationally inserted within the sleeve 216. It is contemplated that the sleeve 216 may further define an access point disposed within the base 204. The access point may be a slot within the base 204 in which the rack member 214 is operationally enabled to couple with the shaft member 212.

In this preferred embodiment, the sleeve 216 is disposed with a fastening assembly 218 which includes a fastener 220 (i.e., bolt) which operationally couples with a first fastening point 222 disposed on a first wall 227 of the sleeve 216, and a second fastening point 224 disposed on the base assembly 204. The sleeve 216 further defines an access point 229 disposed within the base assembly 204. In a preferred embodiment, the access point 229 is a slot within the base assembly 204 in which the rack member 214 is operationally enabled.

It is understood that the fastening assembly 218 enables the coupling of the shaft member 212 with the rack member 214. In the current embodiment, the fastener 220 accomplishes this operational engagement by adjusting the size of the recessed area 219 defined by the sleeve 216 when the handle 206 is received within the recessed area 219. For example, the fastener may establish the sleeve 216 in an "open" position, wherein the recessed area 219 is established in a largest diameter position. The handle 206 may be inserted within the recessed area 219 and then the fastener adjusted to reduce the diameter of the recessed area 219. The fastener may continue this reduction until the sleeve 216 is established in a "closed" position, wherein the recessed area 219 is established in a smallest diameter position. This "closed" position couples the shaft member 212 with the rack member 214, thereby providing for the depth adjustment capabilities of the depth adjustment mechanism of the present invention. The fastener 220 may be various devices, such as a screw, clip, pin, and the like. Further, the fastening assembly 218 may be variously implemented as a threaded assembly, compression assembly, spring-loaded assembly, latch assembly, and the like. Thus, implementation of the fastening assembly 218, and its component features, may be accomplished by those of ordinary skill in the relevant art in various ways.

The sleeve 216 may be in a first "open" position when the fastener 220 is less than fully engaged with both the first and second fastening points. In this open position, the outer wall 227 is enabled in an extended position, wherein the outer wall 227 may be biased or extended away from the base assembly 204. In the present example, the fastener 220 may be disengaged from the second fastening point 224. It is contemplated that the "open" position may be enabled by the fastener 220 in various relative degrees of engagement with the first and second fastening points. In this open position, the handle 206 may be removed from the sleeve 216 or inserted into the sleeve 216. The open position further establishes the shaft member 212 in a position of operational disengagement from the rack member 214 even if the handle 206 is received within the sleeve 216. Thus, in the open position macro adjustments may be made.

To establish a second "engaged" position, the handle 206 may be inserted within the sleeve 216 and the fastener 220 engaged fully with the first and second fastening points. The fastener 220, as it proceeds to full engagement with the first and second fastening points, provides the necessary force to adjust the position of the first wall 227, of the sleeve 216, relative to the base assembly 204. In the engaged position, the first wall 227 of the sleeve 216 is adjusted to a position of close proximity with the base assembly 204, or it may be said that the first fastening point 222 is adjusted to a position of close proximity with the second fastening point 224. Thus, the size of the recessed area 219 defined by the sleeve 216 is reduced when the engaged position is established. With the handle 206 inserted within the sleeve 216, the reduction in the size of the recessed area defined by the sleeve 216 may force the shaft member 212 into engagement with the rack member 214, via the access point 229. The access point 229, in a preferred embodiment, is a statically defined area which may remain in a similar configuration whether the depth adjustment mechanism is established in the open or engaged position.

It is further contemplated that the housing 208, similar to the handle 108, may be enabled in various positions while received within the sleeve 216. This enablement may be provided by various mechanisms as contemplated by those of ordinary skill in the art. For example, a spring-loaded elbow assembly may be coupled with the shaft member 212 and enable the adjustment of the housing 208 relative to the sleeve 116. The first wall 227 may include a mechanism for enabling the re-positioning of the housing 208 without requiring the housing 208 to be removed from the sleeve 216.

The mechanical connector 217 of the shaft member 212 extends to enable operational access to the depth adjustment mechanism. For instance, the router assembly 200 may be coupled with a router table assembly. The router assembly 200 may couple on the underside of a table of the router table assembly. The table may include a through point which allows a device, such as a key, to insert through the table and engage with the mechanical connector 217 of the shaft member 212. Access of the tool to the mechanical connector 217 may be provided by a base access point (i.e., an aperture) defined in the base 204. Alternative configurations for the base access point, as contemplated by those of ordinary skill in the art, may be employed. Thus, a user may adjust the depth of the router bit, relative to the table, by rotating the key. It is understood that various configurations of the router table assembly and the shaft member 212 may be employed without departing from the scope and spirit of the present invention.

In this preferred embodiment, the base 204 is further disposed with a first knob handle 240 and a second knob handle 242. The first and second knob handles may be removable from the base assembly. It is further understood that the knob handles may be replaced with a variety of handle apparatus, such as a post, and "L" shaped handle, and the like. The motor casing 202 further includes a first selector 244 and a second selector 246. The first and second selectors may be used to operate the router assembly 200 by enabling an operator to provide power to a motor disposed within the motor casing 202. Power may be provided through a standard electrical cord, a battery assembly (including re-chargeable batteries), and the like without departing from the scope and spirit of the present invention.

Referring now to FIGS. 9 through 15C, a third exemplary router assembly 300 comprising a motor casing 302 adjustably coupled with a base 304 and a third exemplary depth adjustment mechanism, is shown. The depth adjustment mechanism is enabled as a continuous worm drive assembly enabling an operator to make both coarse "macro" and fine "micro" adjustments in the depth of cut, similar to the capabilities described previously, provided by the router assembly 300.

The worm drive assembly comprises a handle 306 including a housing 308 adjustably coupled with a rotating member 310 which is operationally coupled with a shaft member 312. In a preferred embodiment of FIG. 11, a micro adjust collar 326, similar to the micro adjust collar 120 and 226, is operationally coupled with the housing 308, rotating member 310 and the shaft member 312. A first end of the shaft member 312 couples with the rotating member 310 and a second end 315 of the shaft member 312 includes a mechanical connector 317. The mechanical connector 317 of the shaft member 312 extends to enable operational access to the depth adjustment mechanism. For instance, the router assembly 300 may be coupled with a router table assembly. The router assembly 300 may couple on the underside of a table of the router table assembly. The table may include a through point which allows a device, such as a key, to insert through the table and engage with the mechanical connector 317 of the shaft member 312. Access of the tool to the mechanical connector 317 is provided by a base access point 390 (i.e., an aperture) defined in the base 304. Alternative configurations for the base access point 390, as contemplated by those of ordinary skill in the art, may be employed. Thus, a user may adjust the depth of the router bit, relative to the table, by rotating the key. It is understood that various configurations of the router table assembly and the shaft member 312 may be employed without departing from the scope and spirit of the present invention.

In addition, the depth adjustment mechanism includes a rack member 314 which is coupled with the motor casing 302 for engaging with the shaft member 312. It is contemplated that the rack member 314, similar to the rack member 114 and 214, may be removed form the motor casing 302, enabling retro-fitting of the rack member 314 with a secondary motor casing assembly or retro-fitting of the motor casing 302 with a secondary rack member. The housing 308 is received within a sleeve 316 disposed upon the base 304.

The sleeve 316 defines an at least partially enclosed recessed area 319 within which the housing 308 may be inserted, similar to the defined recessed areas 119 and 219, described above in reference to FIGS. 1 through 8. In a preferred embodiment, the sleeve defines a cylindrical recessed area 319, extending from a first end 321 to a second end 325, for receiving the housing 308. The defined recessed area is for receiving the handle 306 into the sleeve 316. Alternatively, the second end 325 may include a cover which at least partially encloses the cylindrical recessed area of the sleeve 316. In a preferred embodiment, the sleeve 316 defines a cylindrical recessed area on a first end 321, for receiving the housing 308, and a cover 323 on a second end 325 which at least partially encloses the second end 325 of the cylindrical recessed area.

In this preferred embodiment, the sleeve 316 is disposed with a biasing assembly 318 which includes a biasing handle 320 coupled with a pin 327 which operationally couples with a first fastening point 322 disposed on the sleeve 316. The first fastening point 322 is an aperture which is capable of receiving the pin 327. The pin 327 is enabled to rotate, within the aperture, relative to the sleeve 316, thereby, enabling rotation of the biasing handle 320. The biasing handle 320 is coupled with the pin 327 and operationally engages with the housing 308 to establish various positions of the housing 308, as will be described below.

The location and configuration of the sleeve 316 may vary without departing from the scope and spirit of the present invention. By varying the configuration of the sleeve 316, it is contemplated that the sleeve 316 may accommodate variously sized handles of various worm drive assemblies. The ability to change the location of the sleeve 316 may be of particular importance if design changes are being implemented to accommodate operators of the router assembly 300, including the worm drive of the depth adjustment mechanism, based on dominant hand use. For instance, a right-hand dominant operator may prefer having the worm drive assembly in the location illustrated in FIG. 9, while a left-hand dominant operator may prefer the worm drive assembly be disposed on the opposite side of the motor casing assembly 304. The housing 308 and rotating member 310, in the exemplary embodiment, are configured in a generally semi-conical shape in order to reduce the profile and provide increased ease of use of the rotating member 310. However, it is contemplated that the housing 308 and rotating member 310 may be designed to extend the rotating member 310 above the motor casing 302, provide a larger grip surface, or even extend away from the motor casing 302.

In a preferred embodiment, the sleeve 316 is integrated with the base 304. However, the sleeve 316 may be enabled to be removed from the base 304 allowing the retro-fitting of the sleeve 316 with secondary base units or the retro-fitting of the base 304 with various secondary sleeves. This ability may enable the motor casing 302 removal from the base 304 or it may allow for the replacement of the worm drive assembly. For example, the worm drive assembly may be rendered non-functional due to damage to the housing, handle, or fastening assembly. Thus, the present invention may provide a significant advantage by allowing the operator of the router assembly to remove the damaged worm drive assembly and replace it with a new worm drive assembly. This may reduce costs if, as is typically the case with most current router designs, a damaged depth adjustment mechanism required the replacement of the entire router assembly. It is contemplated that the housing 308 of the worm drive assembly may be enabled to be pulled away from the motor casing 302 without being removed from the sleeve 316. In such an instance, it is further contemplated that the rotating member 310 may be enabled with various secondary assemblies, such as a ratcheting assembly, thus when the rotating member 310 extends away from the motor casing 302 the operator is allowed to make depth changes utilizing limited ranges of movement. Such a ratcheting assembly may include a ratchet selector assembly enabling the operator to determine the direction of operation and correspondingly the direction of depth adjustment of the router assembly 300.

It is further contemplated that the handle 306 may be enabled in various positions while received within the sleeve 316. This enablement may be provided by various mechanisms as contemplated by those of ordinary skill in the art. For example, a spring-loaded elbow assembly may be coupled with the shaft member 312 and enable the adjustment of the handle 306 relative to the sleeve 316. The feeder 318 may include a mechanism for enabling the re-positioning of the handle 306 without requiring the handle 306 to be removed from the sleeve 316.

In this preferred embodiment, the base 304 is further disposed with a first knob handle 340 and a second knob handle 342. The first and second knob handles may be removable from the base assembly. It is further understood that the knob handles may be replaced with a variety of handle apparatus, such as a post, and "L" shaped handle, and the like. The motor casing 302 further includes a first selector 344 and a second selector 346. The first and second selectors may be used to operate the router assembly 300 by enabling an operator to provide power to a motor disposed within the motor casing 302. Power may be provided through a standard electrical cord, a battery assembly (including re-chargeable batteries), and the like without departing from the scope and spirit of the present invention.

Figure 12:
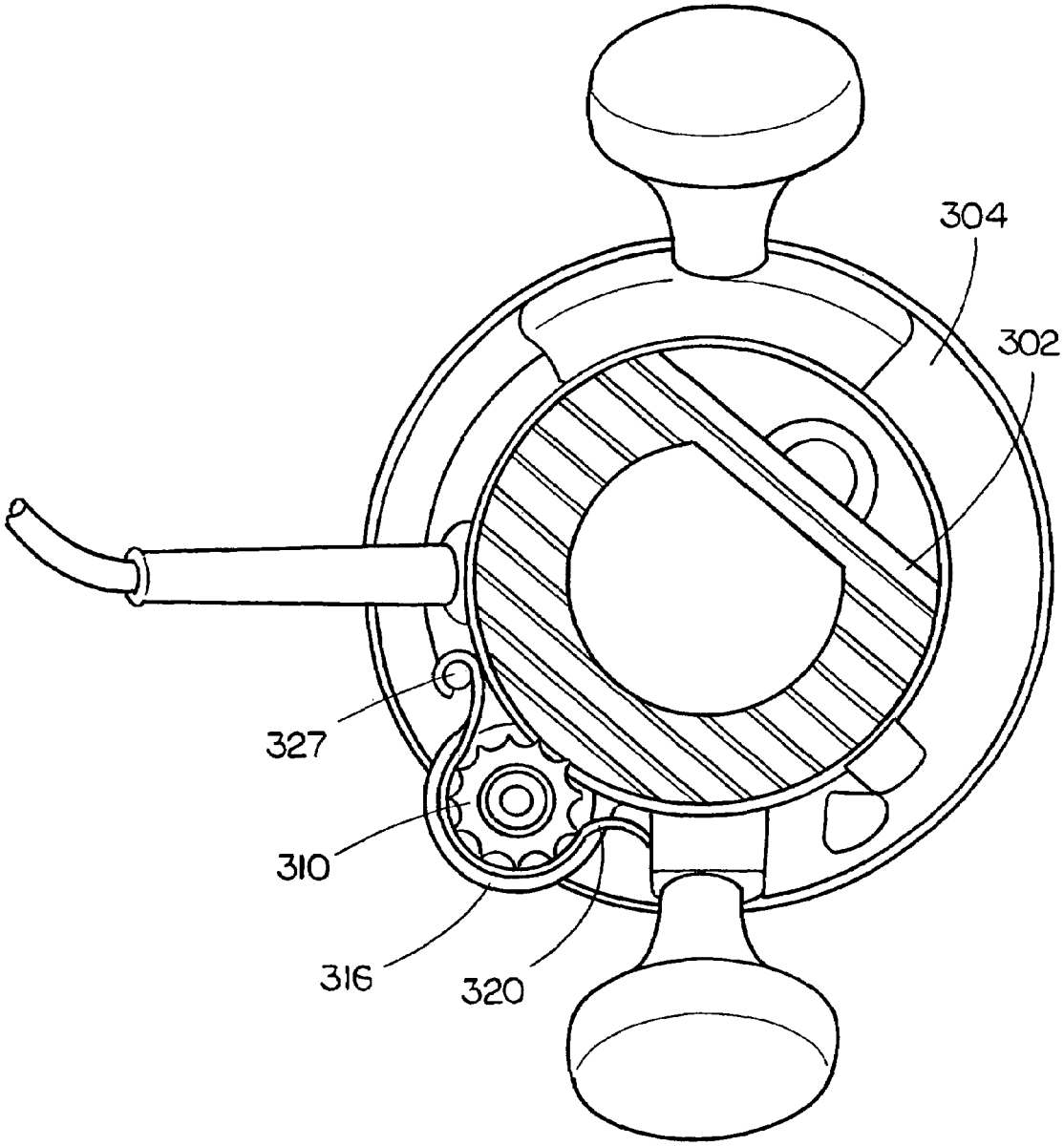
FIG. 12 is a top plan view illustrating the depth adjustment mechanism of FIG. 9 in a closed position with the biasing assembly engaged against the housing which engages a shaft member, disposed within the housing, against a rack member disposed on a motor casing, thereby, enabling continuous metered height adjustment of the router assembly.

The top plan view, illustrated in FIG. 12, of the router assembly 300 shows that the depth adjustment mechanism is disposed in a manner which minimizes its effect on the profile of the router assembly 300. In this preferred embodiment, the worm drive assembly provides a profile which is within that provided by the first knob handle 340. Further, the worm drive assembly limits the need for redesigning the motor casing 302 or the base 304. Therefore, it is contemplated that the motor casing 302 and/or the base 304 may be modular assemblies capable of being replaced by another such modular assembly. This is particularly advantageous to the consumer of this product who may not be forced to purchase an entirely new router assembly if the motor casing 302 and/or base 304, fail in operation. The consumer may limit any repurchase to a new modular motor casing and/or base assembly, insert it into the existing motor casing and/or base assembly, and have a working router assembly once again.

The engagement of the worm drive assembly via the biasing handle 320 coupled with the sleeve 316 provides the router assembly 300 with an integrated depth adjustment mechanism. Thus, an operator of the router assembly 300 is no longer required to employ secondary or external devices in order to make depth of cut adjustments. The present invention may increase ease of use and productivity by not requiring the operator to carry and use these secondary devices. Further, the present invention may provide a significant advantage in that the operator has the ability to make both coarse and fine adjustments in cut depth using the present invention. By releasing the biasing handle 320 the operator may make coarse depth adjustments by manually adjusting the position of the motor casing 302 relative to the base 304. Once the initial coarse setting is established the operator may engage the biasing handle 320, thereby engaging the shaft member 312 with the rack member 314, to enable the fine adjustment of cut depth to be made using the worm drive assembly of the present invention.

Figure 13:
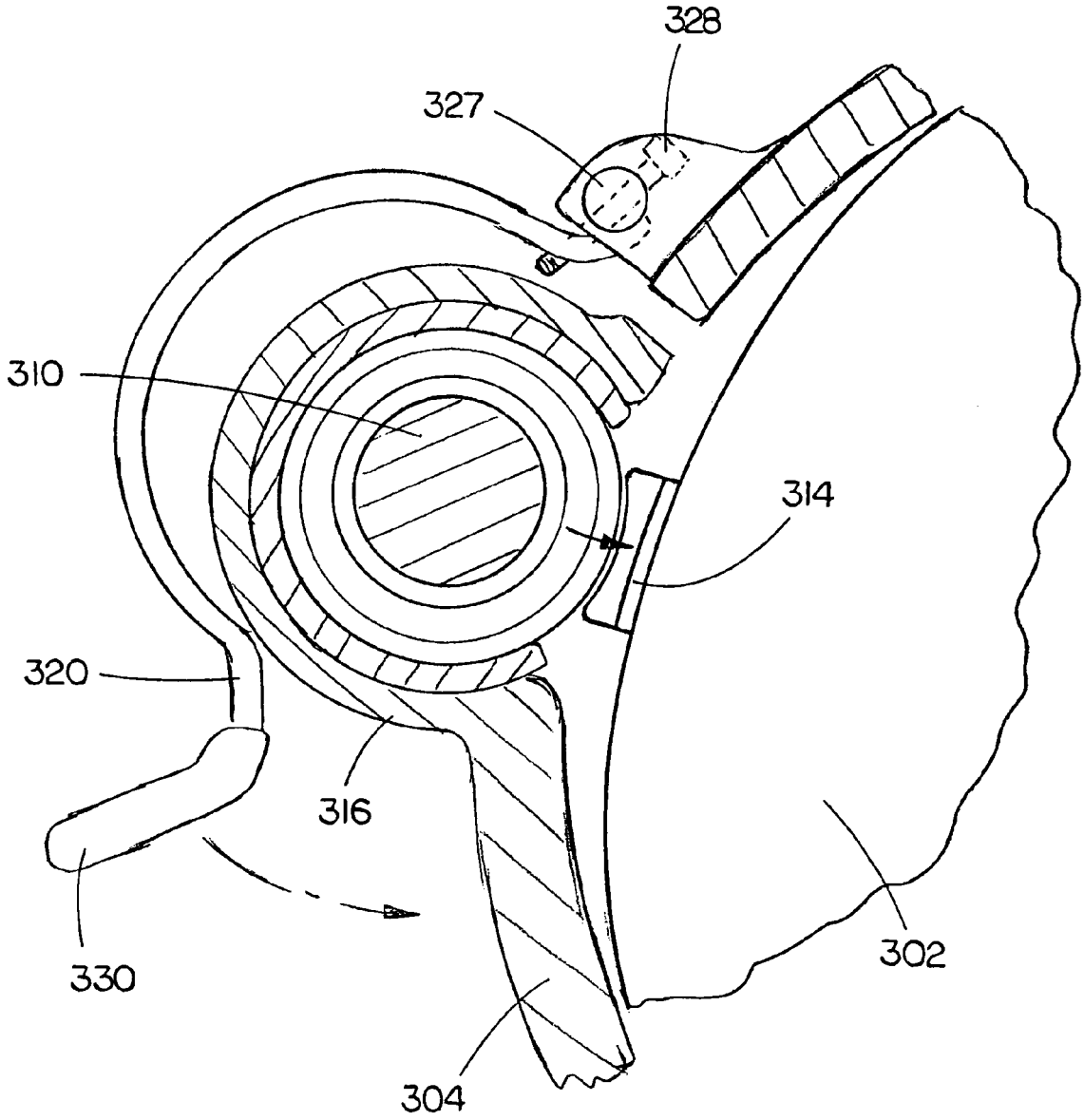
FIG. 13 is a perspective top plan view illustrating the depth adjustment mechanism of FIG. 9 in an open position releasing the engagement of the biasing assembly with the housing and the engagement of the shaft member with the rack member.
Figure 14:
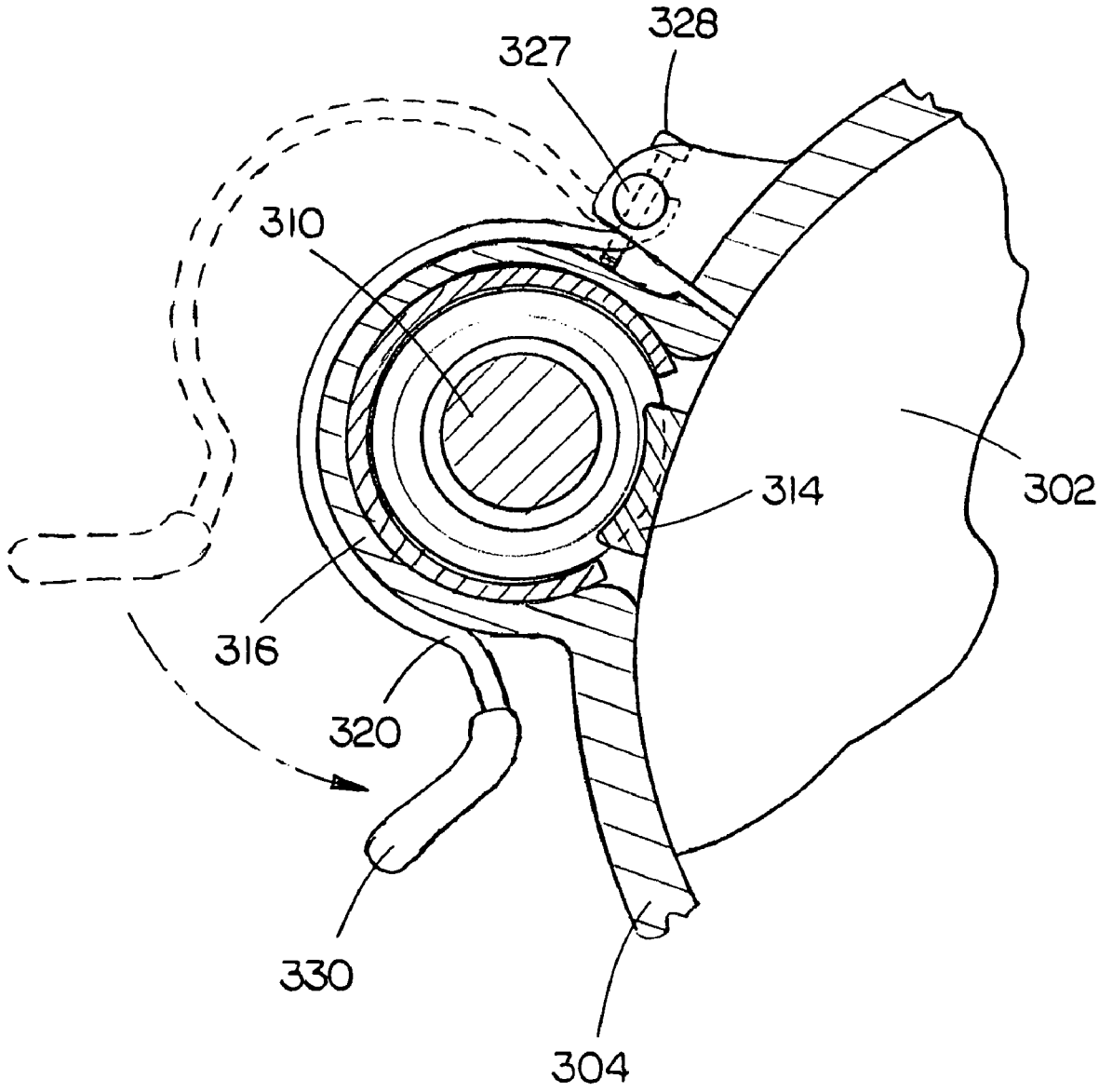
FIG. 14 is an illustration of the movement capabilities of the biasing assembly, wherein the biasing assembly may selectively engage or dis-engage the housing in the closed or open position, respectively, resulting in the selective engagement and/or dis-engagement of the shaft member with the rack member of the worm drive assembly.

FIGS. 13 and 14 illustrate an exemplary range of movement of the biasing handle 320 in relation to the housing 308. In a preferred embodiment, the biasing handle 320 may be established in a first (closed or locked) position, wherein the biasing handle 320 is engaged against the housing 308 or the biasing handle 320 may be in a second (open) position wherein the biasing handle 320 is not engaged against the housing 308. It is contemplated that the number of positions enabled for the biasing handle 320 may vary as contemplated by those of skill in the art. As discussed previously, the biasing handle 320 is coupled with the pin 327 which in turn is received within the first fastening point 322. The first fastening point 322 securely affixes the pin 327 and allows for the pin 327 to rotate relative to the housing 308 and the sleeve 316. Thus, the range of movement of the biasing handle 320, enabled by the pin 327 rotating within the first fastening point 322, may be unlimited, preferably the range is between ten degrees and forty five degrees. The preferred range of movement enabling the biasing handle to be established in at least the first and second position in order to enable the functionality of the present invention. In the present embodiment, the biasing handle 320 encompasses a section of the housing 308 and does not engage the rotating member 310. The biasing handle 320 may be of various configurations as contemplated by one of ordinary skill.

When the biasing handle 320 is in the locked position, engaged against the housing 308, as shown in FIG. 14, the worm drive assembly is engaged. Thus, the shaft member 312 is operably engaged or meshed with the rack member 314. Therefore, an operator may rotate the rotating member 310, which in turn rotates the shaft member 312 causing its position to change relative to the rack member 314, and changing the depth of cut provided by the router assembly 300. Referring now to FIG. 13, the fastening assembly 320 is shown in an open or disengaged position. The open position is evidenced by the biasing handle 320 not being engaged against the housing 308 and the shaft member 312 being spaced apart from the rack member 314, which is disposed on the motor casing 302.

It is understood that when the worm drive assembly is in the open or disengaged position that coarse or macro depth adjustment may occur manually by the operator manually moving the motor casing 302 relative to the base 304. Further, it is understood that the motor casing 302 may be statically positioned relative to the base 304 regardless of the engagement or disengagement of the worm drive assembly. The operation and functionality of the router assembly 300 when the worm drive assembly is disengaged, other than the ability to make fine adjustments, is not affected. In FIG. 13 the distance traveled by the housing 308, including the shaft member 312, between engagement and disengagement with the rack member 314 disposed upon the motor casing 302, is shown. The distance is narrowly limited to provide the minimum separation needed between the shaft member 312 and the rack member 314 when the worm drive assembly is disengaged. In a preferred embodiment, the available travel distance of the housing 308 including the shaft member 312 may be equivalent to the depth of the spiral threads in the shaft member 312.

It is further contemplated that the fastening assembly 318 may include a fastener 328, as shown in FIGS. 13 and 14. The fastener 328 may engage with the pin 327 via the first fastening point 322. The fastener 328 may promote a secure seating of the pin 327 within the first fastening point 322. Additionally, the fastener 328 may be used to limit the range of movement of the pin 327 within the first fastening point 322. A grip 330 is shown to be coupled with the biasing handle 320. The grip 330 may be of various configurations and materials as contemplated by those of ordinary skill in the art.

Figures 15A, 15B, 15C:
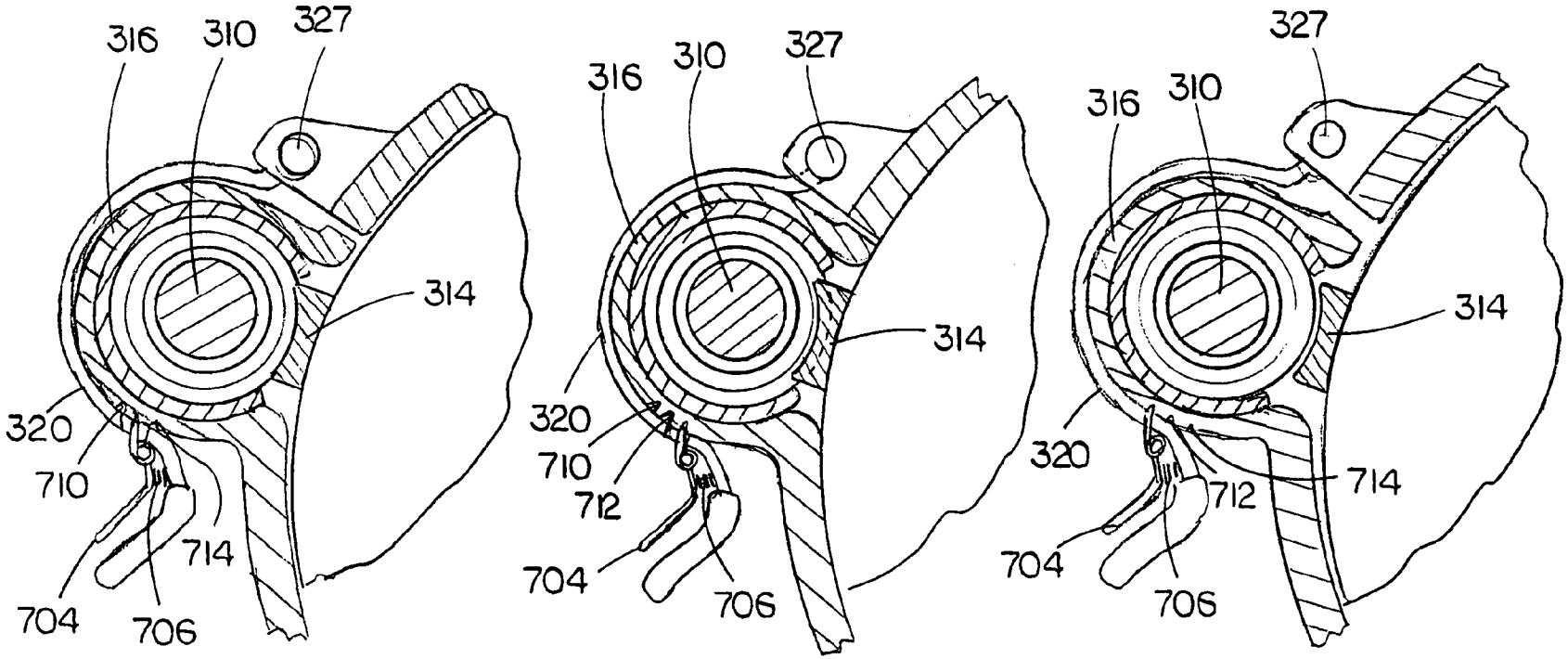
FIGS. 15A, 15B, and 15C are illustrations of the depth adjustment mechanism of FIG. 9 including a lock assembly operationally disposed upon the biasing assembly and the sleeve, the lock assembly enabling a plurality of stops capable of being engaged in a plurality of positions.
Figure 16:
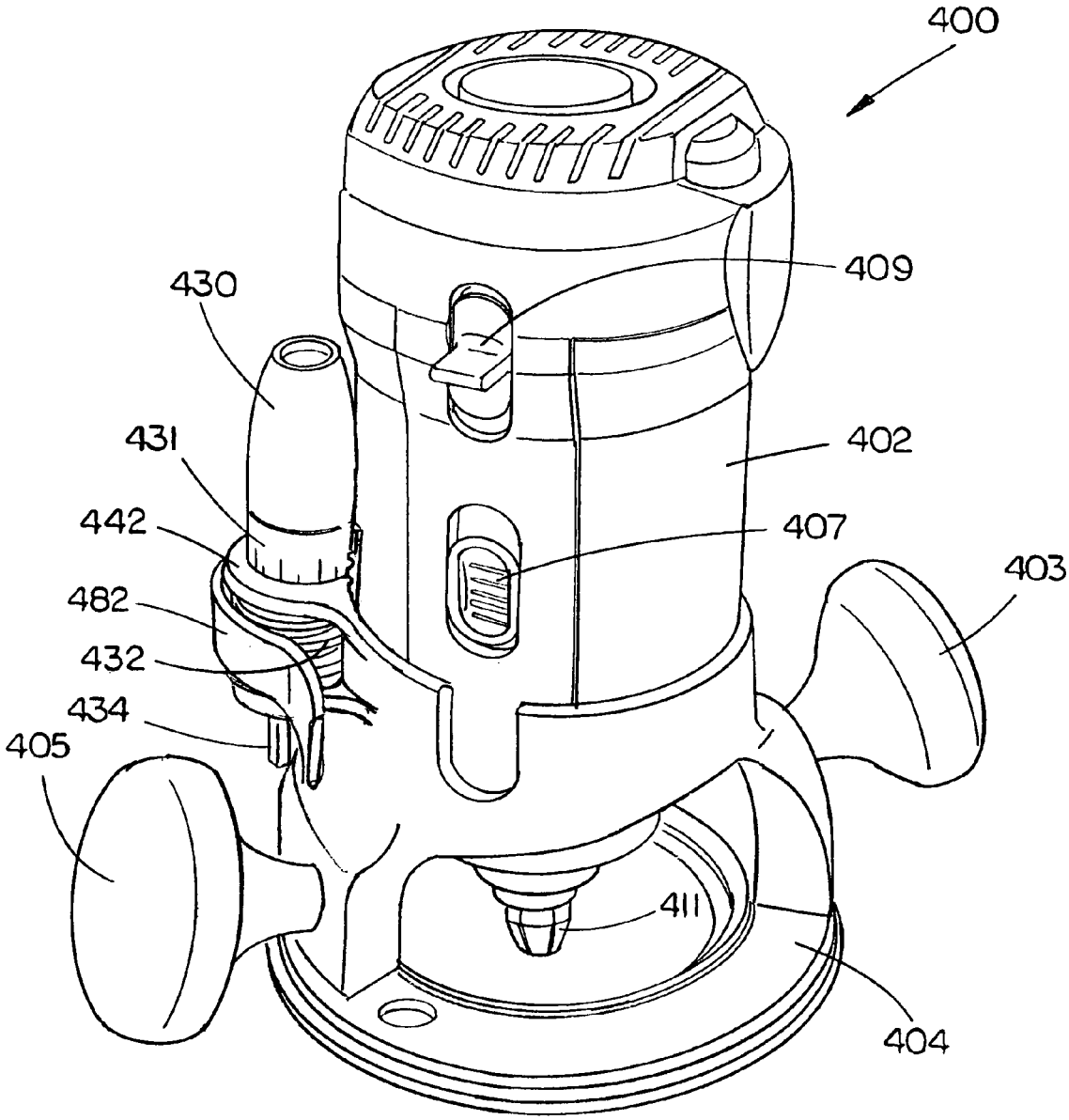
FIG. 16 is an isometric view illustrating a fourth exemplary embodiment of a router assembly including a depth adjustment mechanism enabled via a worm drive assembly including a housing coupled with a handle coupled with a shaft member which engages a rack member disposed on a motor casing, wherein a second exemplary embodiment of a biasing assembly enables the selective engagement of the shaft member with the rack member in accordance with the present invention.
Figure 17:
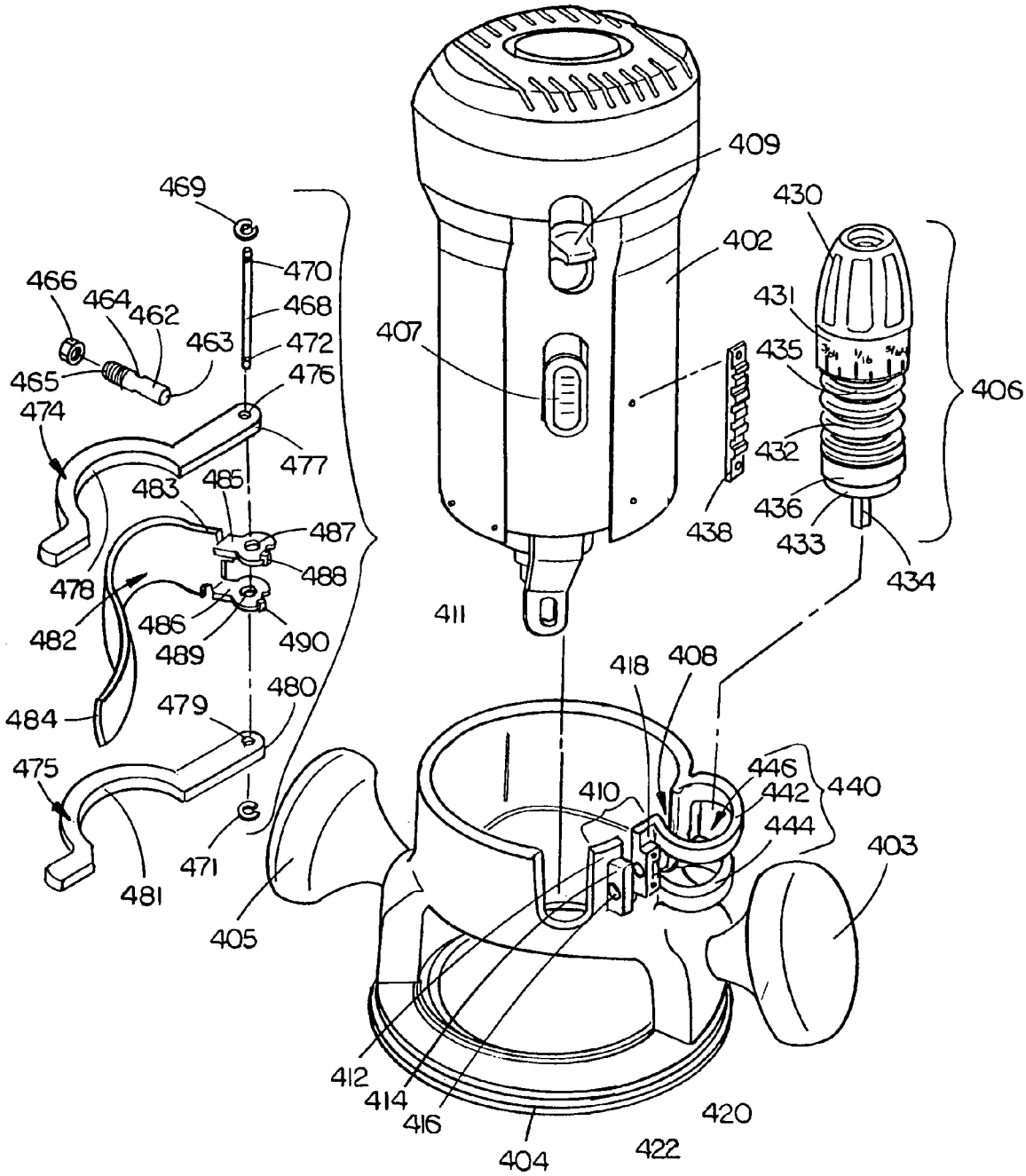
FIG. 17 is an exploded view illustrating the router assembly including the depth adjustment mechanism of FIG. 16.
Figure 18:
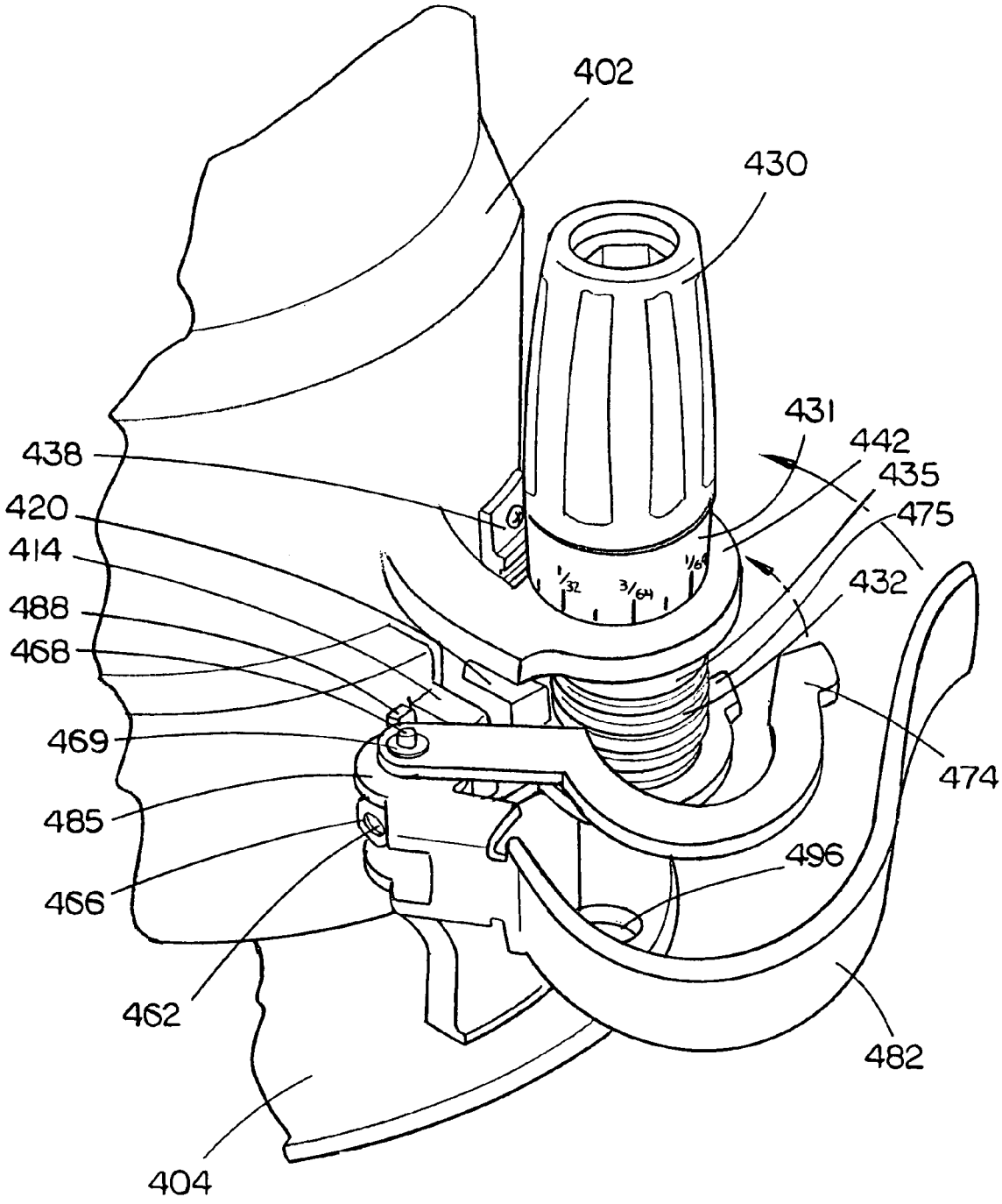
FIG. 18 is an illustration of the depth adjustment mechanism of FIG. 16, including a micro adjust collar coupled with a handle.
Figure 19:
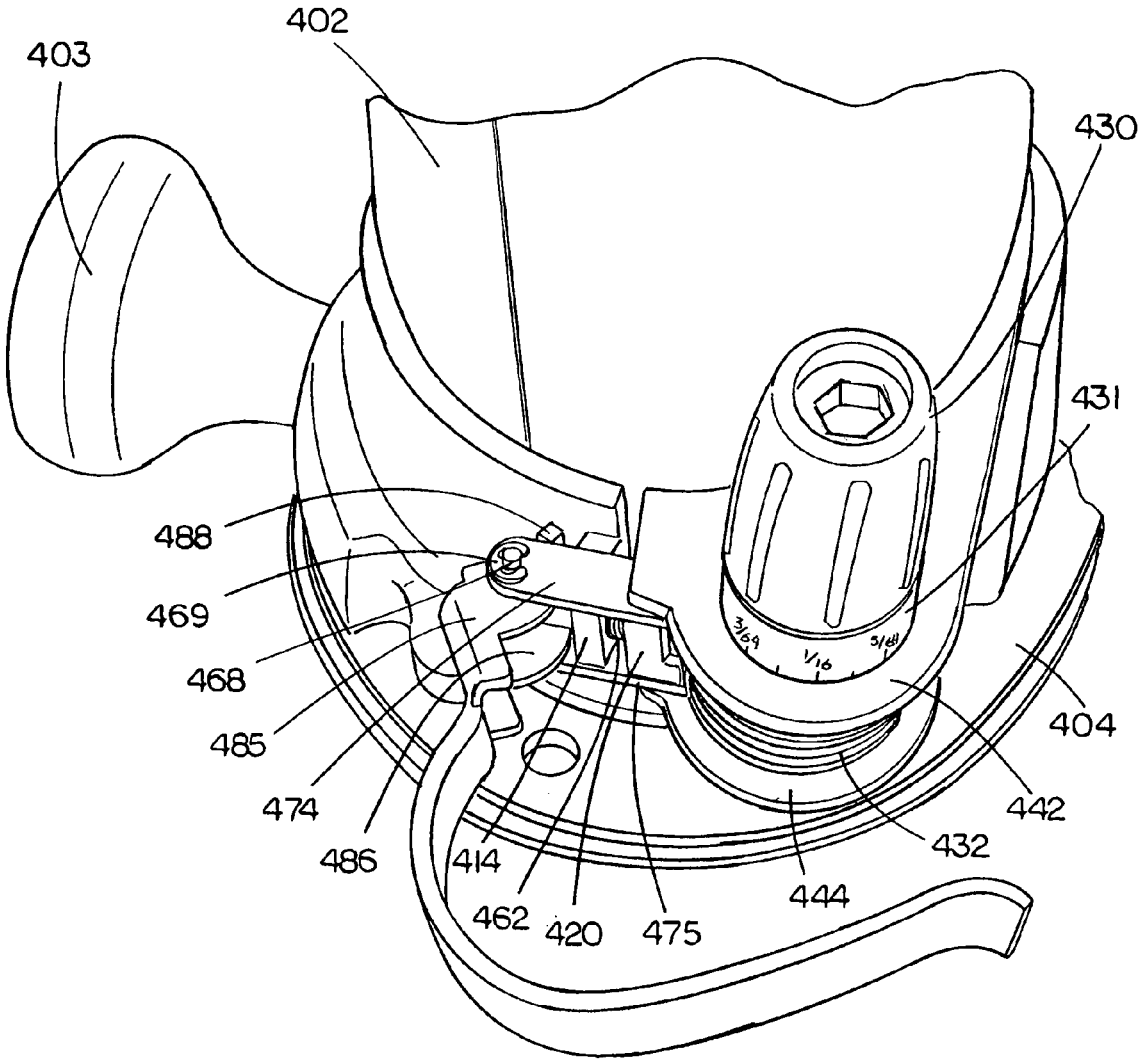
FIG. 19 is a top plan perspective view illustrating the router assembly including the depth adjustment mechanism of FIG. 16 in an open or released position.
Figure 20:
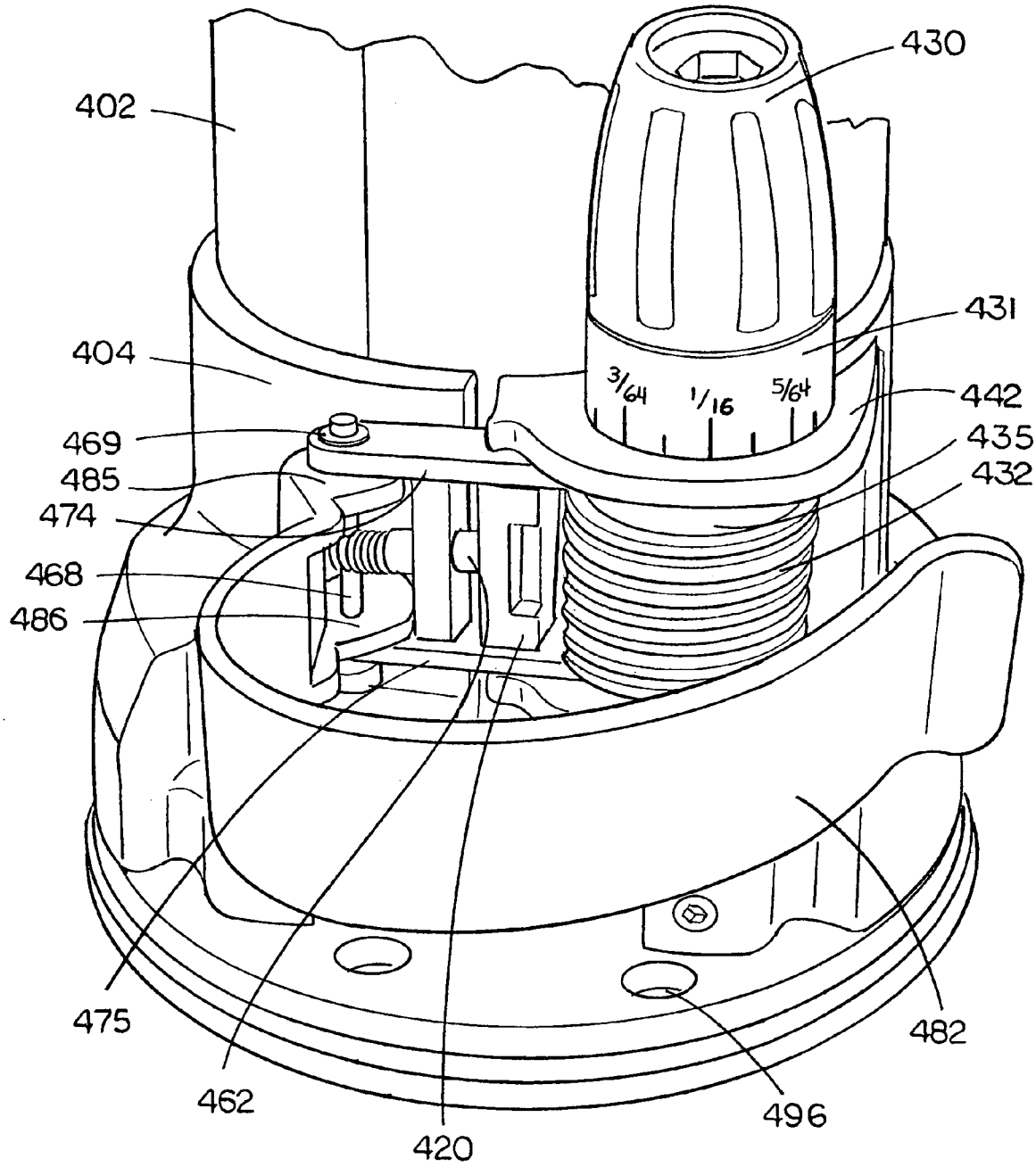
FIG. 20 is a front plan view illustrating the open or released position of the depth adjustment mechanism of the router assembly of FIG. 16.
Figure 21:
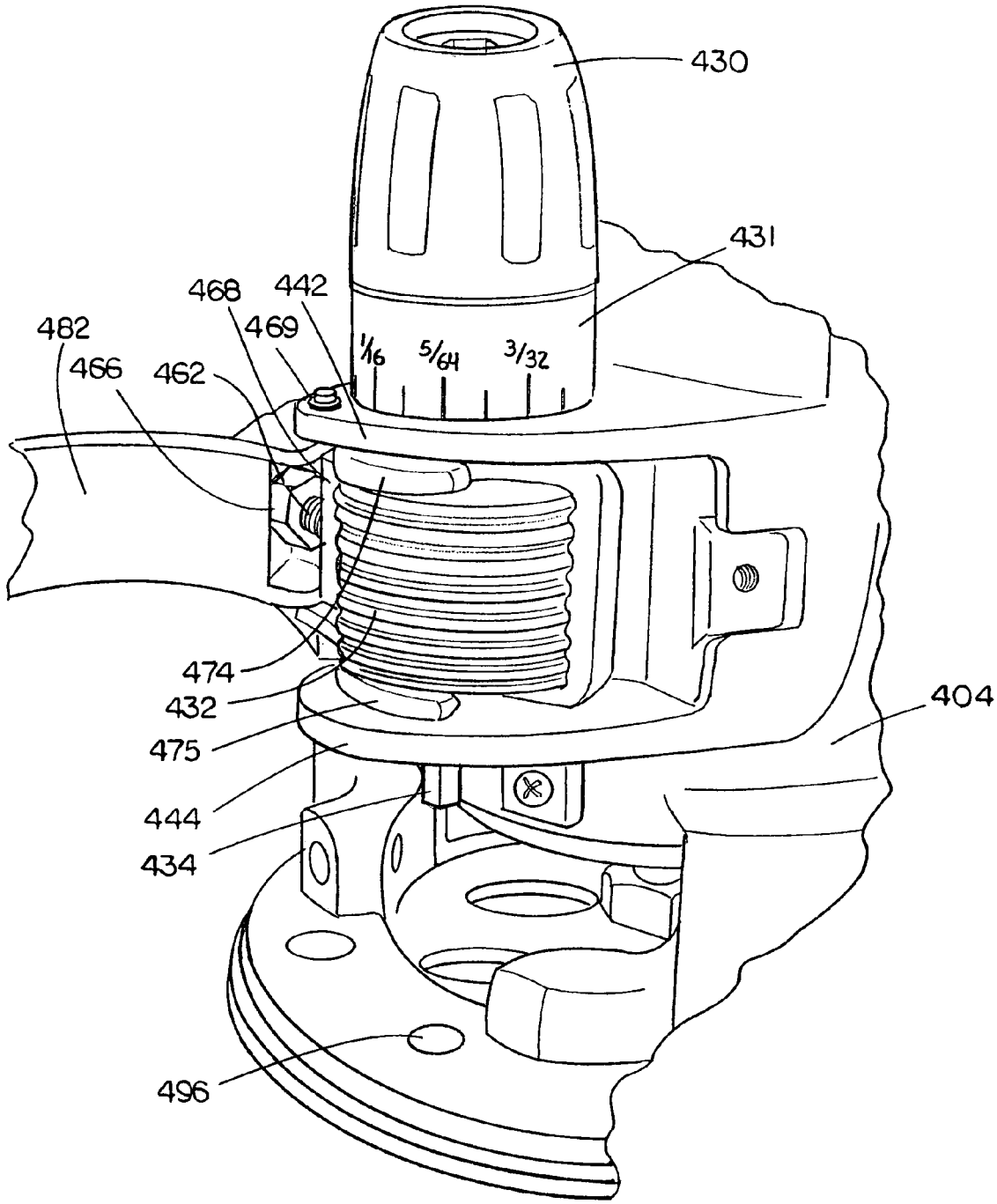
FIG. 21 is a side elevation view illustrating the open or release position of the depth adjustment mechanism of the router assembly of FIG. 16.
Figure 22:
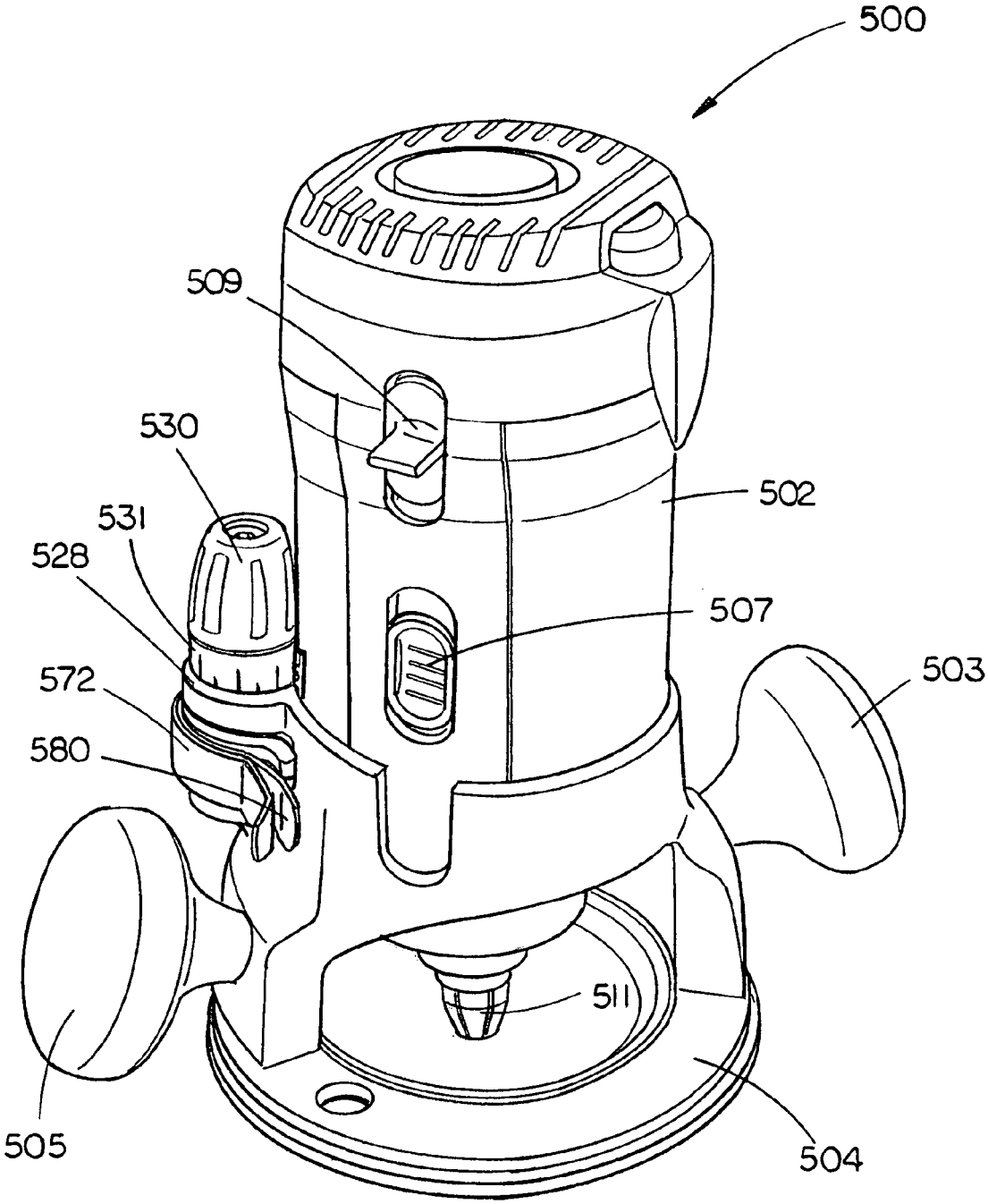
FIG. 22 is an isometric view illustrating a fifth exemplary embodiment of a router assembly including a depth adjustment mechanism enabled via a worm drive assembly including a housing coupled with a handle coupled with a shaft member which engages a rack member disposed on a motor casing, wherein a third exemplary embodiment of a biasing assembly including a biasing cover enables the selective engagement of the shaft member with the rack member in accordance with the present invention.
Figure 23:
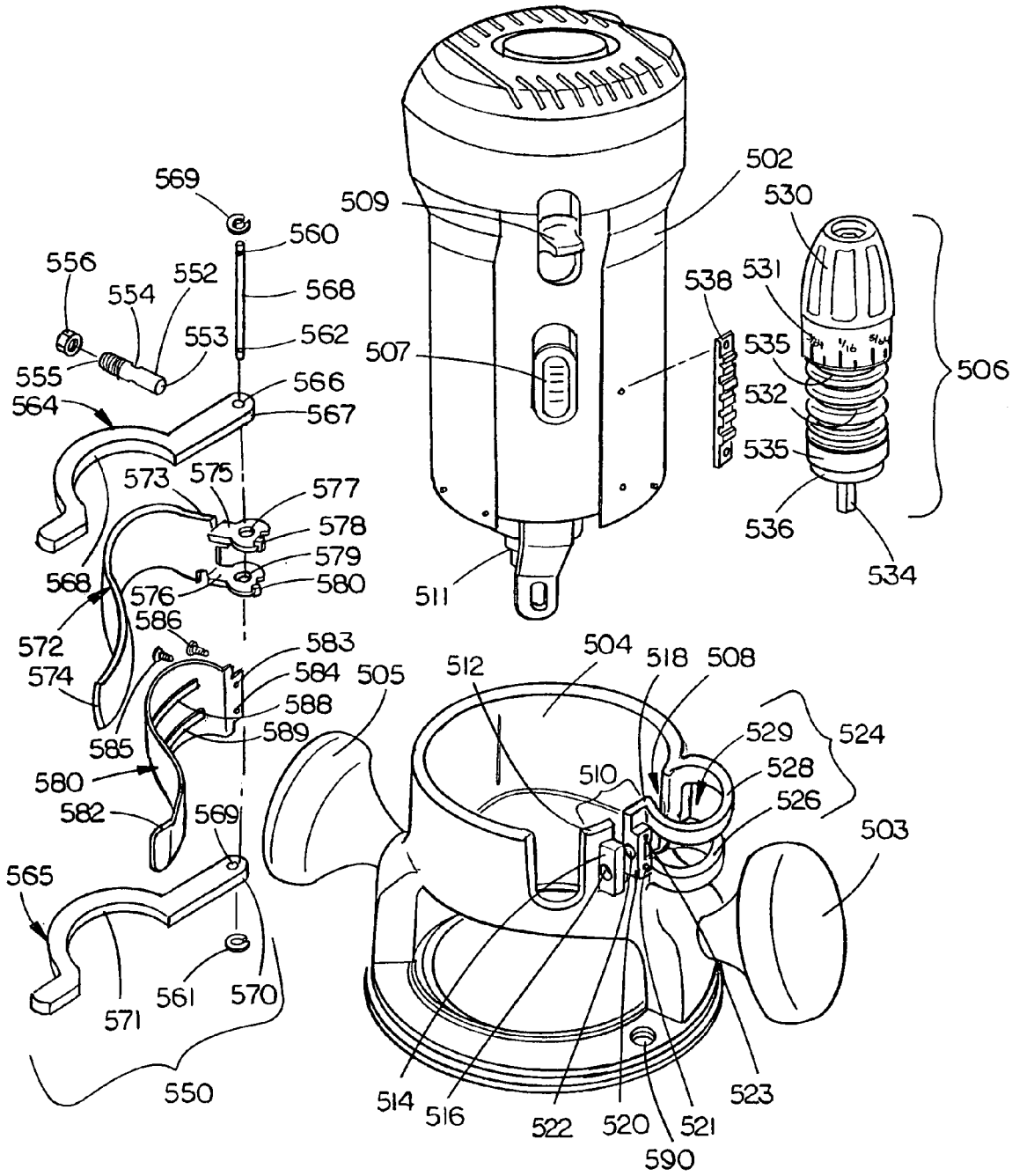
FIG. 23 is an exploded view of the router assembly of FIG. 22.
Figure 24:
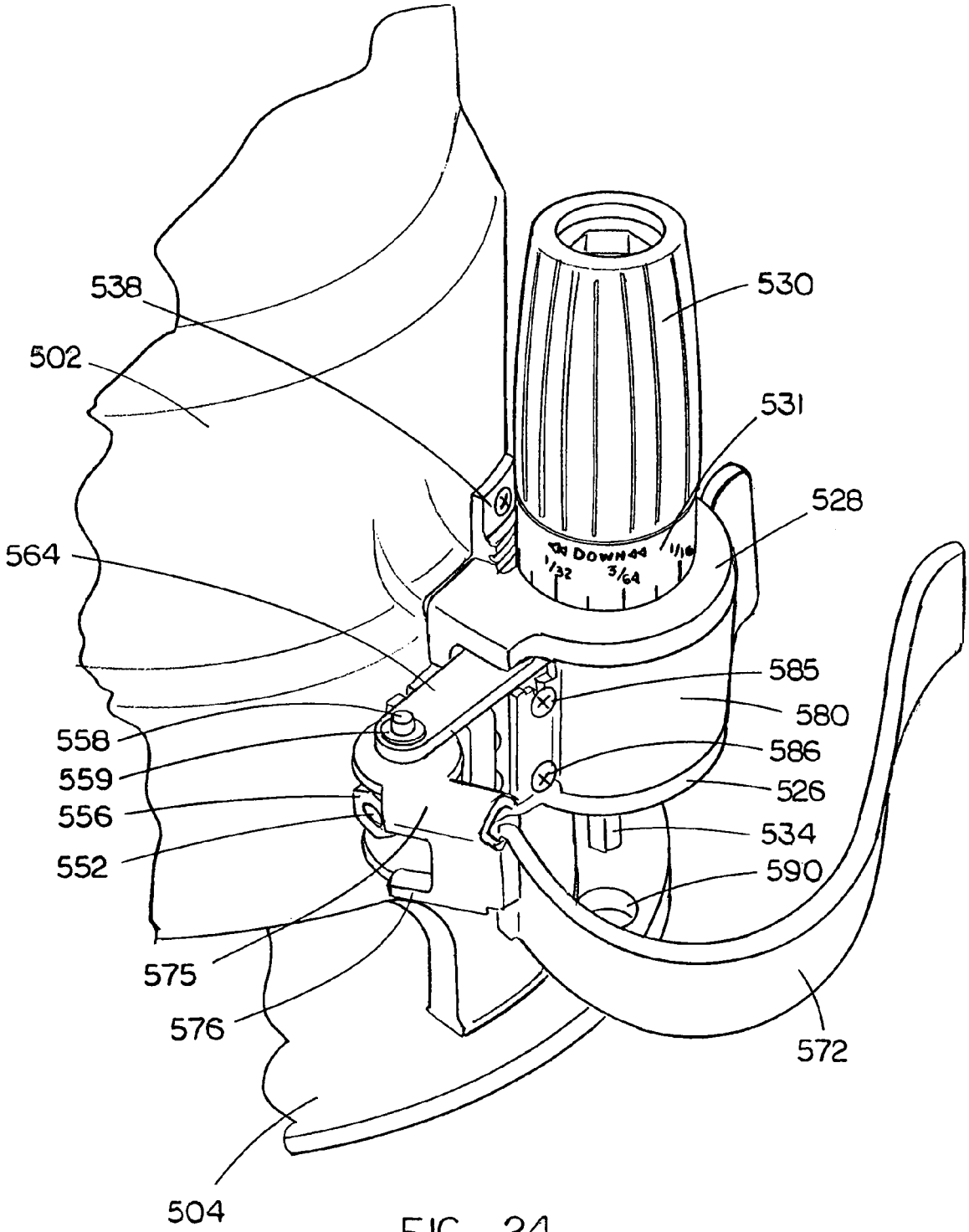
FIG. 24 is a top plan perspective view illustrating an open position of the depth adjustment mechanism of the router assembly of FIG. 22.
Figure 25:
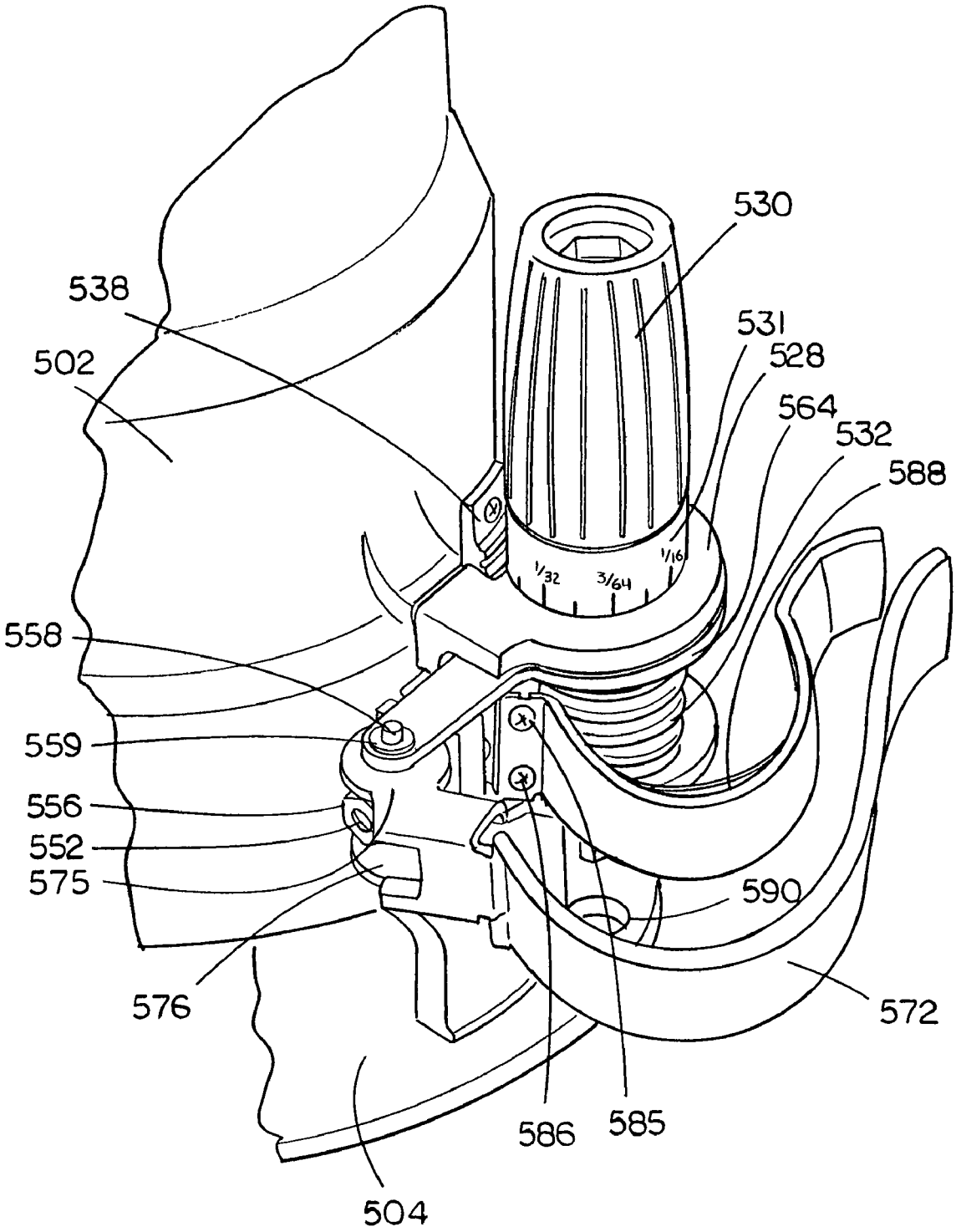
FIG. 25 is a side elevation view illustrating an open position of the depth adjustment mechanism of the router assembly of FIG. 22.
Figure 26:
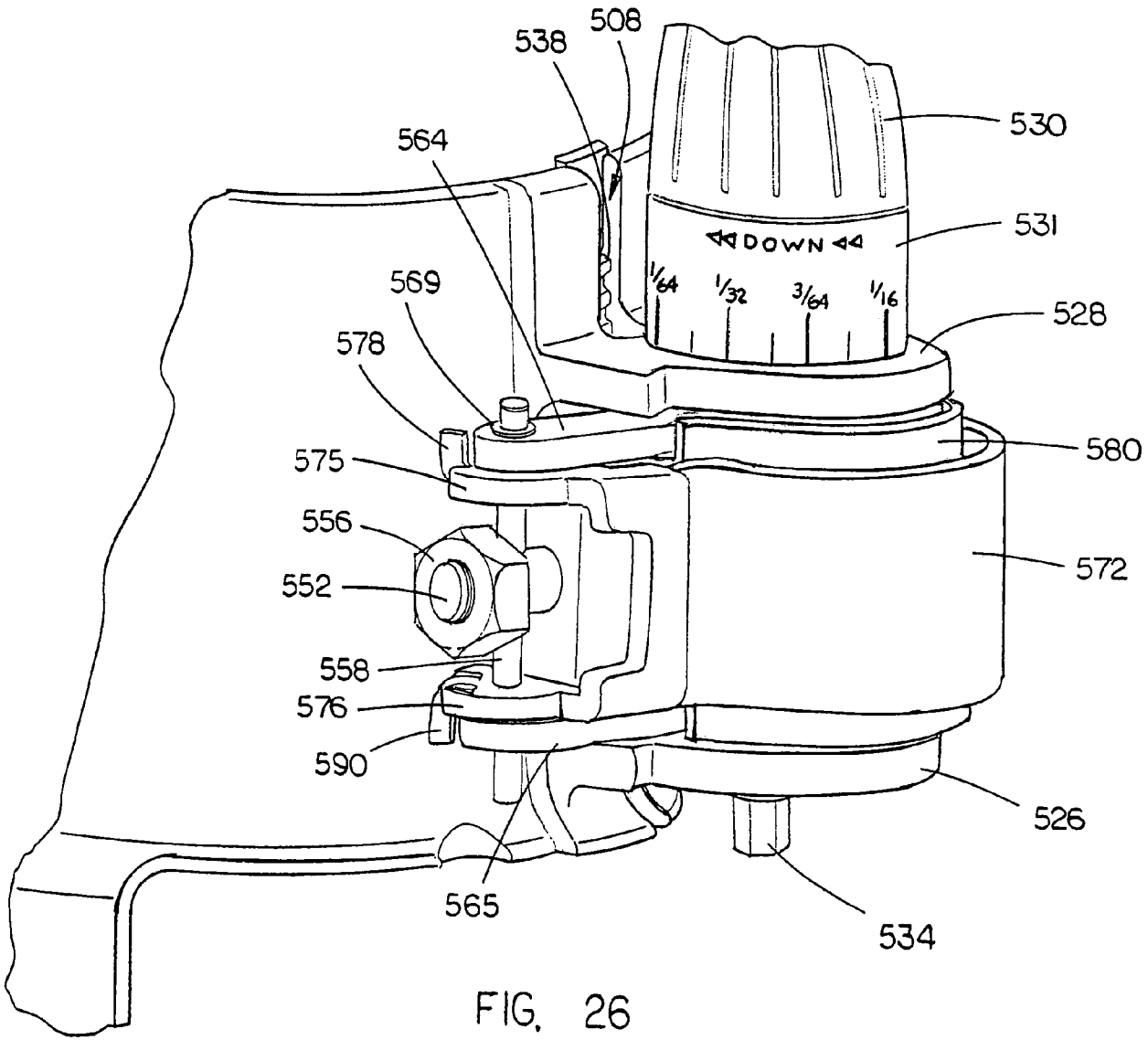
FIG. 26 is a side elevation view illustrating a closed position of the depth adjustment mechanism of the router assembly of FIG. 22.
Figure 27:
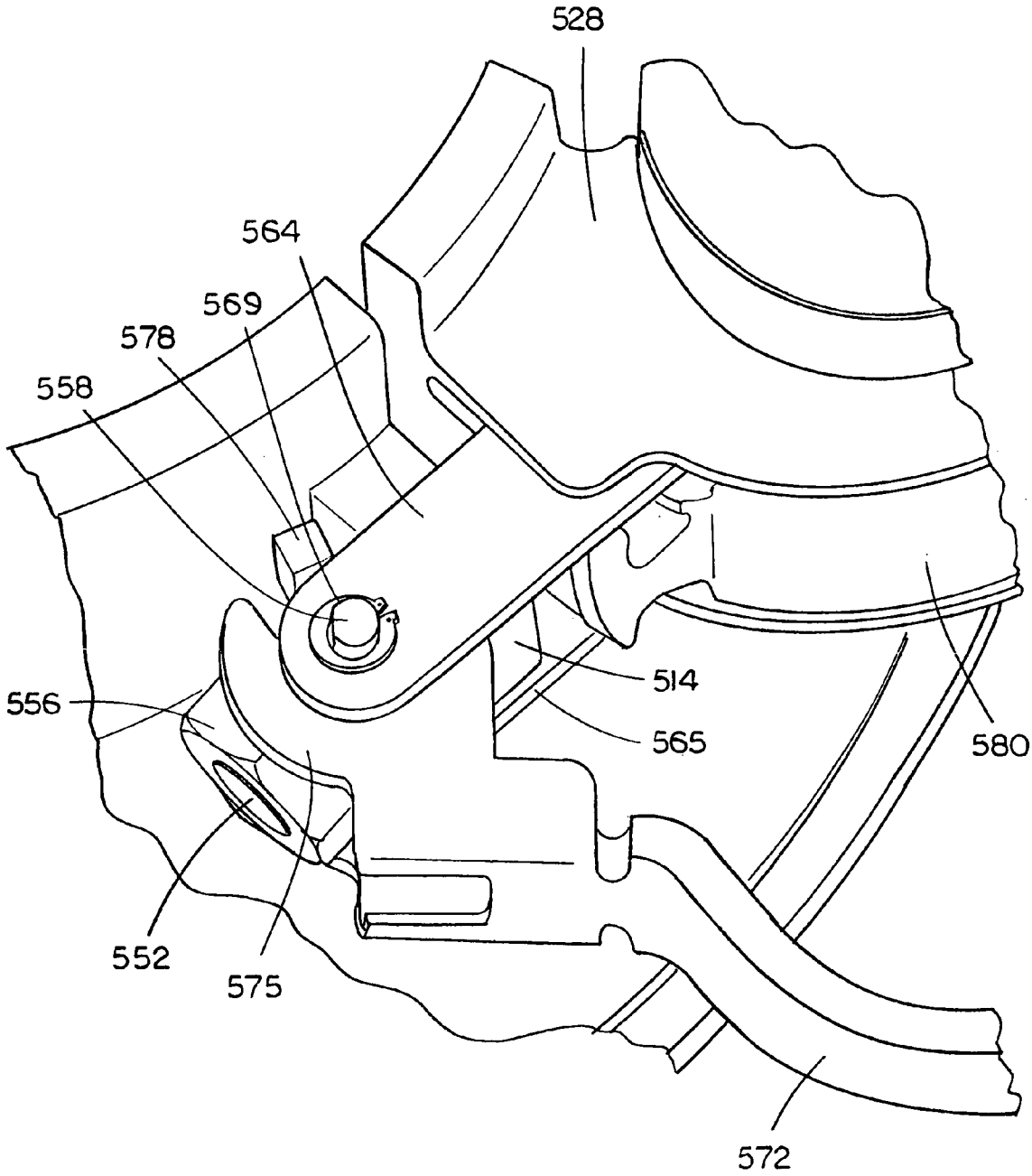
FIG. 27 is a perspective view illustrating the biasing assembly including the handle adjustably coupled with a first bracket, the handle further including a tab for engaging the first bracket.
Figure 28:
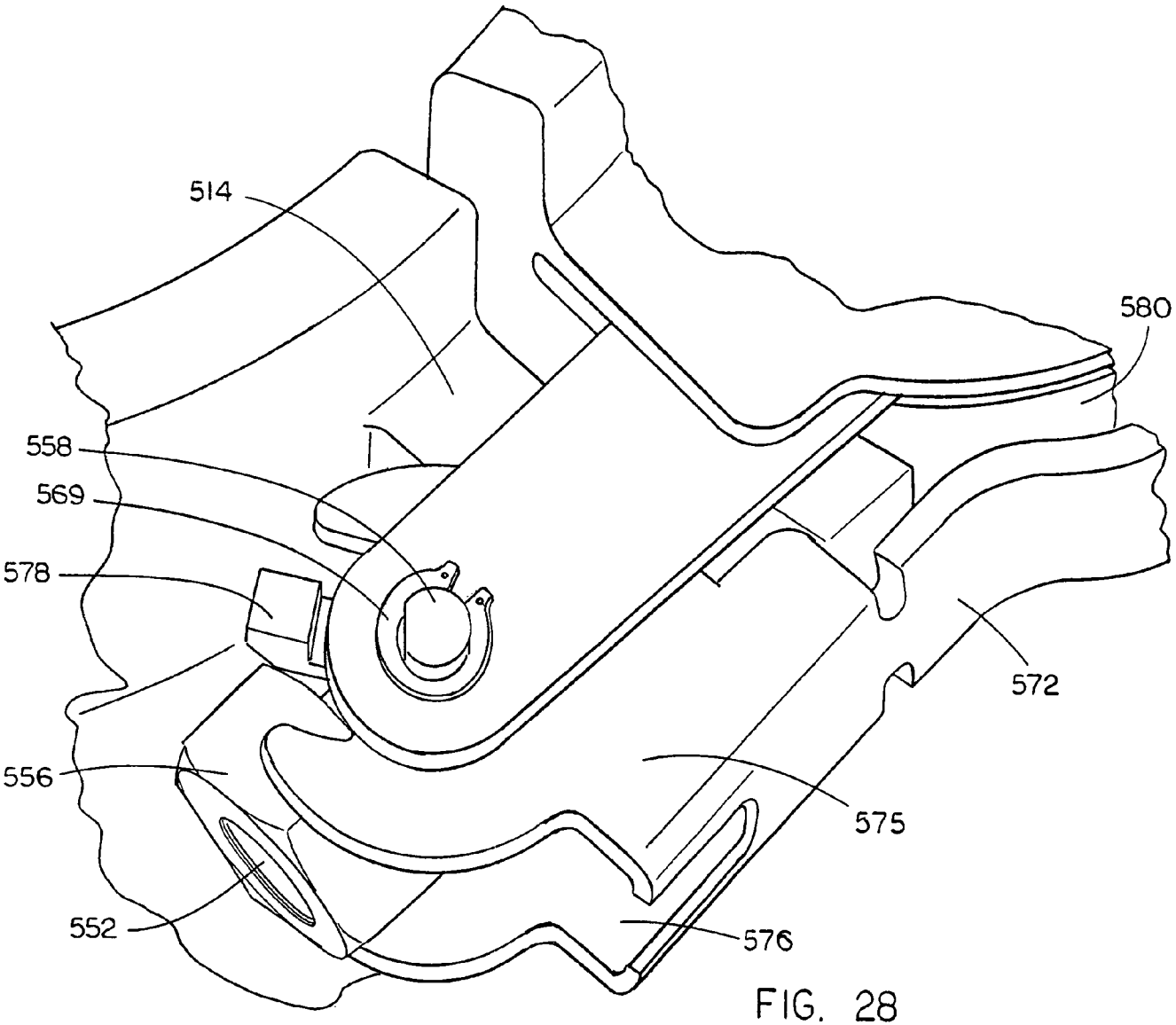
FIG. 28 is an expanded view of the adjustable coupling of the handle with the first bracket and the tab, disposed on the handle, which selectively engages and/or disengages against the first bracket for biasing the position of the first bracket.
Figure 30:
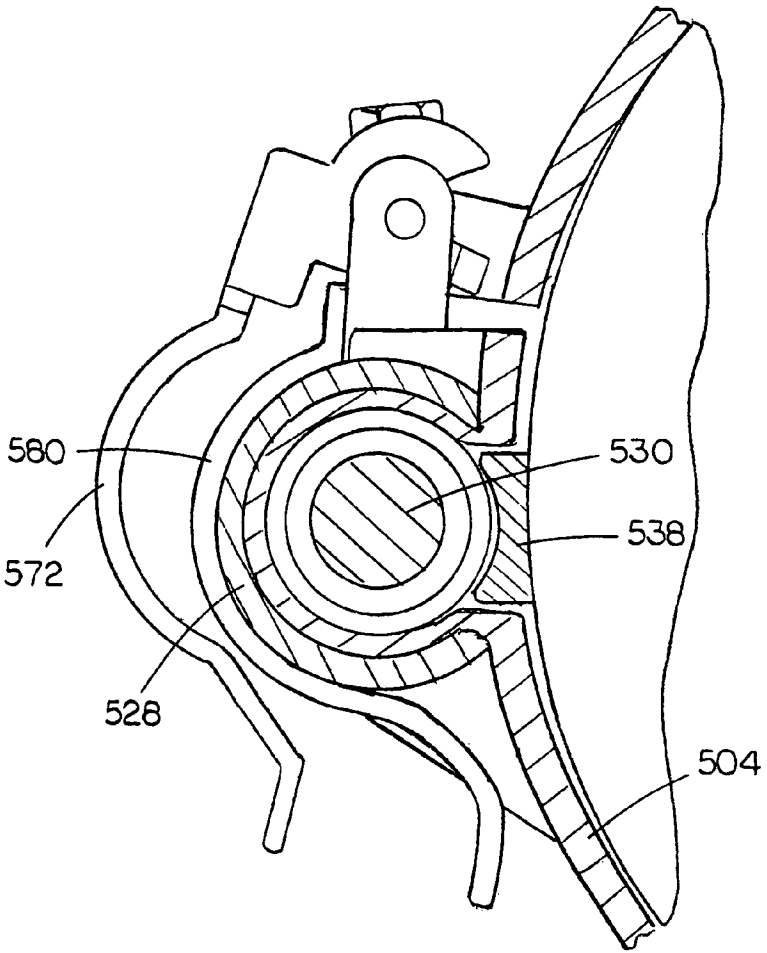
FIG. 30 is a perspective view illustrating the open position enabled by the depth adjustment mechanism of the router assembly of FIG. 22.
Figure 29:
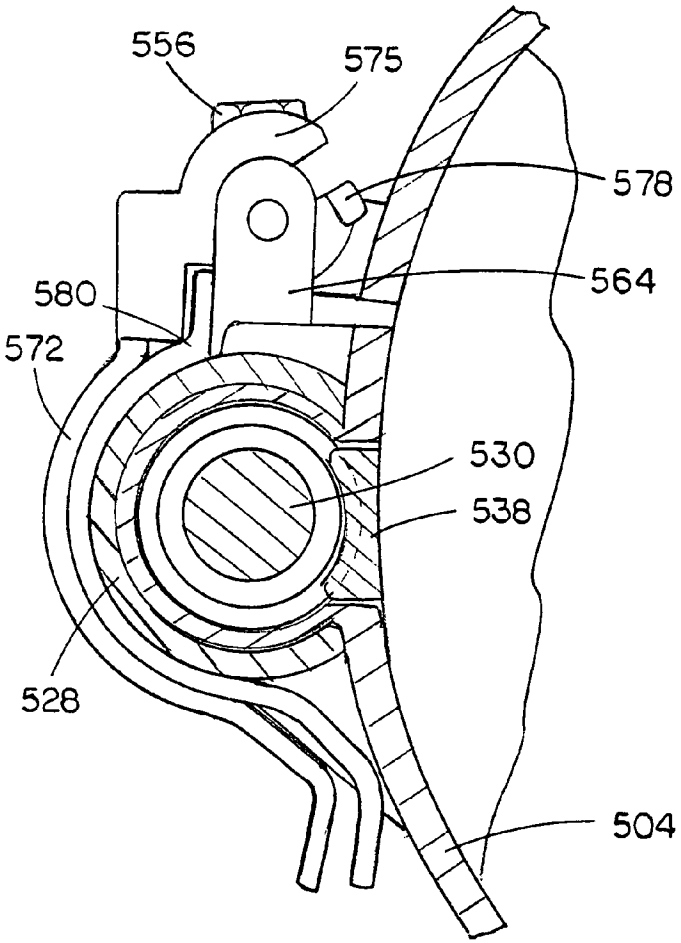
FIG. 29 is a perspective view illustrating the closed position enabled by depth adjustment mechanism of the router assembly of FIG. 22.

Referring now to FIGS. 15A, 15B, and 15C, the worm drive assembly is shown including a lock assembly. The lock assembly includes an activator 704 coupled with a spring 706. The spring 706 is further coupled with the biasing handle 320. The activator 704 operably engages with a plurality of engagement receptacles 710, 712, and 714, disposed on the sleeve 316. Thus in a preferred embodiment shown, the spring loaded activator 704 may be positioned in one of three positions. In FIG. 15C, the activator 704 is shown engaged with the engagement receptacle 710. This establishes a first ("open") position for the depth adjustment mechanism, wherein the shaft member 312 is not engaged with the rack member 314. When the activator is in this position the worm drive assembly is disengaged. A user may manually move the motor casing 302 relative to the base 304 in order to accomplish macro adjustments. In FIG. 15B, activator 304 is shown engaged with the engagement receptacle 714. This establishes a third ("fully engaged") position for the depth adjustment mechanism, wherein the shaft member 312 is fully engaged with the rack member 314. When the lock assembly is in this position the worm drive assembly is fully engaged and therefore rotation of the rotating member 310 provides the continuous metered depth adjustment capabilities of the present invention.

In FIG. 15A, the activator 704 is shown engaged with the engagement receptacle 712. This establishes a second ("partially engaged") position for the depth adjustment mechanism, wherein the shaft member 312 is partially engaged with the rack member 314. When the lock assembly is in this position the worm drive assembly is in a partial engagement position. In a partial engagement position the worm drive assembly may not be enabled to provide depth adjustment through rotation of the rotating member 310. However, the operator of the router assembly may manually adjust the depth of the router and the partial engagement of the shaft member 312 with the rack member 314 may provide a securing of the position of the motor casing 302 relative to the base 304. In this way the router assembly is fully functional and the motor casing 302 is prevented from moving relative to the base 304. This may be advantageous when the router assembly is in operation and a movement of the motor casing 302, resulting in a depth adjustment of the router bit, may destroy the work being performed.

Referring generally now to FIGS. 16 through 21, a fourth exemplary router assembly 400 comprising a motor casing 402 adjustably coupled with a base 404 and a depth adjustment mechanism is shown. The depth adjustment mechanism is enabled as a continuous worm drive assembly operationally engaging with a biasing assembly for enabling an operator to make both coarse "macro" and fine "micro" adjustments in the depth of cut provided by the router assembly 400. In a preferred embodiment, the base 404 is disposed with a slotted access point 408 and a slotted assembly 410. The slotted access point 408 enables the operation of the depth adjustment mechanism, as will be described below. The slotted assembly 410 may preferably be an aperture, defined by a first side 412 and a second side 418, in the base 404. The first side 412, of the slotted assembly 410, includes a first tab 414, which further includes a first fastening point 416. The second side 418, of the slotted assembly 410, includes a second tab 420, which further includes a second fastening point 422.

The worm drive assembly comprises a handle 406 including a rotating member 430, which is operationally coupled with a first end of a shaft member 432. The shaft member 432, shown in FIGS. 16 and 17, further includes a second end 433. The second end 433 further includes a mechanical connector 434. The mechanical connector 434 of the shaft member 432 extends to enable operational access to the depth adjustment mechanism. For instance, the router assembly 400 may be coupled with a router table assembly. The router assembly 400 may couple on the underside of a table of the router table assembly. The table may include a through point which allows a device, such as a key, to insert through the table and engage with the mechanical connector 434 of the shaft member 432. Access of the tool to the mechanical connector 434 is provided by a base access point 496 (i.e., an aperture) defined in the base 404. Alternative configurations for the base access point 496, as contemplated by those of ordinary skill in the art, may be employed. Thus, a user may adjust the depth of the router bit, relative to the table, by rotating the key. It is understood that various configurations of the router table assembly and the shaft member 432 may be employed without departing from the scope and spirit of the present invention.

Additionally, disposed on the shaft member 432 is a first biasing receiver 435 and a second biasing receiver 436 which may be operationally engaged by components of a biasing assembly, described below. In a preferred embodiment, a micro adjust collar 431, similar to the micro adjust collar 120 and 226, is operationally coupled with the rotating member 430 and the shaft member 432. Additionally, a rack member 438 is coupled with the motor casing 402 for engaging with the shaft member 432. It is contemplated that the rack member 438, similar to the rack member 114 and 214, may be removed from the motor casing 402, enabling retro-fitting of the rack member 438 with a secondary motor casing assembly or retro-fitting of the motor casing 402 with a secondary rack member. In the current embodiment, the rack member 438 is disposed upon the motor casing 402 in a position which aligns it with the slotted access point 408 of the base 404.

The handle 406 is received within a sleeve 440 disposed upon the base 404. The sleeve 440 defines an at least partially enclosed recessed area within which the housing 430 may be inserted. In a preferred embodiment, the sleeve 440 includes a first rib 442 and a second rib 444 which define a generally cylindrical recessed area 446, for receiving the housing 430. The second rib 444 may provide a partially enclosed area for engaging with the housing 430 and the second end 433 of the shaft member 432. The generally cylindrical recessed area, established by the first and second ribs of the sleeve 440, at least partially encompasses the slotted access point 408 disposed upon the base 404. The shaft member 432 engages with the rack member 438 via the slotted access point 408, when the housing 430 is received in the sleeve 440.

In this preferred embodiment, the depth adjustment mechanism further includes a biasing assembly 460. The biasing assembly 460 includes a post member 462, which couples through the first and second fastening point 416 and 422 of the first and second tab 414 and 420, respectively. In a preferred embodiment, the post member 462 is a rod which is threaded on both a first end 463 and a second and 465. The first end 463 inserts into and fastens within the second fastening point 422 after passing through the first fastening point 416. Disposed along the post member 462 is a pin receiver 464. The pin receiver 464, in the current embodiment, is a generally cylindrically shaped aperture which provides for engagement with other components of the biasing assembly 460, as will be described below. Coupled with the second end 465 is a fastener 466 which promotes the securing of the position of the post member 462 once inserted into the first and second fastening points. The fastener 466 couples with the post member 462 and then may engage against the first tab 414. For instance, the fastener 466 may be a nut which may be threaded along the post member 462, when the post member 462 has been inserted and fastened within the second fastening point 422, until it reaches an optimum position along the post member 462.

The post member 462 is coupled with a pin 468 which operationally couples with the post member 462 through the pin receiver 464. A first clip 469 couples with a first end 470 of the pin 468 and a second clip 471 couples with a second end 472 of the pin 468. The first and second clips secure the position of the pin 468 relative to other components of the biasing assembly 460, as described below. It is understood that the pin receiver 464 enables the pin 468 to rotate, within the aperture, relative to the post member 462.

The biasing assembly 460 further includes a first bracket 474 and a second bracket 469. The first bracket 474 includes a first bracket receiver 476 disposed proximal to a first end 477 of the first bracket 474. The first bracket 474 has a second end 478 configured to engage with the shaft member 432. The second bracket 475 includes a second bracket receiver 479 disposed proximal to a first end 480 of the second bracket 475. The second bracket 475 has a second end 481 configured to engage with the shaft member 432.

In a preferred embodiment illustrated in FIGS. 17 through 21, the operational engagement of the first and second brackets with the router assembly 400, is shown. The first end 477 of the first bracket 474 is seated on a first side of both the first and second tab 414 and 420. The first end 480 of the second bracket 475 is seated on a second side of both the first and second tab 414 and 420. It is understood, that the preferred embodiment seats the first and second brackets on opposite sides of the first and second tabs from one another. The first bracket receiver 476 is engaged by the pin 468 which extends through the first bracket receiver 470 to engage through the second bracket receiver 479.

A biasing handle 482 includes a first end 483 and a second end 484. The first end 483 includes a first biasing handle bracket 485 and a second biasing handle bracket 486. The first biasing handle bracket 485 includes a first pin receiver 487 and a first biasing tab 488. The second biasing handle bracket 486 includes a second pin receiver 489 and a second biasing tab 490. It is contemplated that the biasing handle 482 may include a secondary tension assembly disposed on the inside wall of the first biasing handle 480. The first and second pin receiver 487 and 489, in a preferred embodiment, are configured as apertures through the first and second biasing handle bracket 485 and 486. The apertures enable the pin 468 to engage through the first and second biasing handle bracket 485 and 486, as shown in FIGS. 17 through 21, and couple the biasing handle 482 with the pin 468 which couples with the fastener member 462 which couples with the first and second tab 414 and 420 of the router assembly 400. Further, the pin 468 enables the biasing handle 482 to rotate relative to the router assembly 400 and the other components of the biasing assembly 460. This provides for the operational engagement of the biasing assembly 460 and determines the engagement of the worm drive of the depth adjustment mechanism.

The biasing assembly 460 provides the force for engaging the shaft member 432 against the rack member 438. In the exemplary embodiment, the biasing assembly 460 accomplishes this through engagement of the biasing handle 482 with the second end 478 of the first bracket 474 and second end 481 of the second bracket 475. In operation, the biasing handle 482 may be manually engaged by an operator of the router assembly 400. The operator may rotate the biasing handle 482 to establish the worm drive in an engaged or open position.

To establish the open position, the biasing handle 482 is rotated away from the base 404. This rotation causes the first and second biasing tab 488 and 490 to engage against the first bracket 474 and second bracket 475, respectively. This engagement causes the first and second bracket 474 and 475 to bias away from the shaft member 432. The second end 478 of the first bracket 474 and the second end 481 of the second bracket 475 engage with the first biasing receiver 435 and the second biasing receiver 436 of the shaft member 432. When the first and second biasing tabs of the biasing handle 482 engage with the first and second brackets, respectively, the second ends of the first and second brackets bias away from engagement with the biasing receivers. In the open position the user may make macro adjustments to the height of the motor casing 402 relative to the base 404. It is contemplated that the first and second biasing tab 488 and 490 may be variously configured to provide the biasing functionality.

To establish the engaged position, which enables the worm drive as a functional depth adjustment mechanism, the biasing handle 482 is rotated towards the base 404 into a closed position. The closed position results in the biasing handle 482 engaging against the first and second bracket 474 and 475. This engagement biases the first and second brackets towards the base 404 and into engagement with the first and second biasing receiver 435 and 436, respectively, of the shaft member 432. The engagement of the first and second bracket 474 and 475 with the first and second biasing receiver 435 and 436 imparts a force which results in the shaft member 432 meshing with the rack member 438 disposed on the motor casing 402.

It is contemplated that the biasing handle 482 may be enabled to operationally couple with a securing mechanism when in the engaged or closed position. For example, a latch assembly may be disposed on the base 404 in a position which enables it to couple with the biasing handle 482 when it is engaging against the first and second brackets. Alternatively, a receiver may be disposed on the base 404 which may be engaged by the biasing handle 482. For example, the receiver may be a compression lock and the biasing handle 482 may be disposed with a compression clip which is located in a position to enable its engagement with the compression lock. A release mechanism may be coupled with the compression lock or included with the compression clip. For example, a push button may be included on the biasing handle 482 which is operational coupled with the compression clip and provides a release functionality when pushed.

Referring generally now to FIGS. 22 through 34, a fifth exemplary router assembly 500 comprising a motor casing 502 adjustably coupled with a base 504 and a depth adjustment mechanism 506, is shown. The depth adjustment mechanism is enabled as a continuous worm drive assembly operationally engaging with a biasing assembly for enabling an operator to make both coarse "macro" and fine "micro" adjustments in the depth of cut provided by the router assembly 500. In a preferred embodiment, the base 504 is disposed with a slotted access 508 and a slotted assembly 510. The slotted access 508 enables the operation of the depth adjustment mechanism, as will be described below. The slotted assembly 510 may preferably be an aperture, defined by a first side 512 and a second side 518, in the base 504. The first side 512, of the slotted assembly 510, includes a first tab 514, which further includes a first fastening point 516. The second side 518, of the slotted assembly 510, includes a second tab 520, which further includes a second fastening point 522.

The worm drive assembly comprises a handle 506 including a rotation member 530 operationally coupled with a first end of a shaft member 532. The shaft member 532, shown in FIGS. 23 and 25, further includes a second end 533. Additionally, disposed on the shaft member 532 is a first biasing receiver 535 and a second biasing receiver 536 which may be operationally engaged by components of a biasing assembly, described below. In a preferred embodiment, the handle 506 further includes a micro adjust collar 531, similar to the micro adjust collar 120, 226, and 431, and is operationally coupled with the rotation member 530 and the shaft member 532. Additionally, a rack member 538 is coupled with the motor casing 502 for engaging with the shaft member 532. It is contemplated that the rack member 538, similar to the rack member 114, 214, and 438, may be removed from the motor casing 502, enabling retro-fitting of the rack member 538 with a secondary motor casing or retro-fitting of the motor casing 502 with a secondary rack member. In the current embodiment, the rack member 538 is disposed upon the motor casing 502 in a position that aligns it with the slotted access 508 of the base 504.

The handle 506 is received within a sleeve 524 disposed upon the base 504. The sleeve 524 defines an at least partially enclosed recessed area within which the handle 506 may be inserted. In a preferred embodiment, the sleeve 524 includes a first rib 526 and a second rib 528 which define a generally cylindrical recessed area 529, for receiving the handle 506. The second rib 528 may, in alternative embodiments, provide a partially enclosed area for engaging with the handle 506 and the second end 533 of the shaft member 532. The generally cylindrical recessed area 529, established by the first and second ribs of the sleeve 524, at least partially encompasses the slotted access 508 disposed upon the base 504. The shaft member 532 is enabled to engage with the rack member 538 via the slotted access 508, when the handle 506 is received in the sleeve 524.

In a preferred embodiment, the depth adjustment mechanism further includes a biasing assembly 550. The biasing assembly 550 includes a post member 552, which couples through the first and second fastening point 516 and 522 of the first and second tab 514 and 520, respectively. In a preferred embodiment, the post member 552 is a rod which is threaded on both a first end 553 and a second end 555. The first end 553 inserts into and fastens within the second fastening point 522 after passing through the first fastening point 516. Disposed along the post member 552 is a pin receiver 554. The pin receiver 554, in the current embodiment, is a generally cylindrically shaped aperture which provides for engagement with other components of the biasing assembly 550, as will be described below. Coupled with the second end 555 is a fastener 556 which promotes the securing of the position of the post member 552 once inserted into the first and second fastening points. The fastener 556 couples with the post member 552 and then may engage against the first tab 514. For instance, the fastener 556 may be a nut which may be threaded along the post member 552, when the post member 552 has been inserted and fastened within the second fastening point 522, until it reaches an optimum position along the post member 552.

The post member 552 is coupled with a pin 558, which operationally couples with the post member 552 through the pin receiver 554. A first clip 559 couples with a first end 560 of the pin 558 and a second clip 561 couples with a second end 562 of the pin 468. The first and second clips secure the position of the pin 558 relative to other components of the biasing assembly 550, as described below. It is understood that the pin receiver 554 enables the pin 558 to rotate, within the aperture, relative to the post member 552.

The biasing assembly 550 further includes a first bracket 564 and a second bracket 559. The first bracket 564 includes a first bracket receiver 566 disposed proximal to a first end 567 of the first bracket 564. The first bracket 564 has a second end 568 configured to engage with the shaft member 532. The second bracket 565 includes a second bracket receiver 569 disposed proximal to a first end 570 of the second bracket 565. The second bracket 565 has a second end 571 configured to engage with the shaft member 532.

In a preferred embodiment illustrated in FIGS. 24 through 28, the operational engagement of the first and second brackets with the router assembly 500, is shown. The first end 567 of the first bracket 564 is seated on a first side of both the first and second tab 514 and 520. The first end 570 of the second bracket 565 is seated on a second side of both the first and second tab 514 and 520. It is understood, that the preferred embodiment seats the first and second brackets on opposite sides of the first and second tabs from one another. The first bracket receiver 566 is engaged by the pin 558, which extends through the first bracket receiver 560 to engage through the second bracket receiver 569.

A biasing handle 572 includes a first end 573 and a second end 574. The first end 573 includes a first biasing handle bracket 575 and a second biasing handle bracket 576. The first biasing handle bracket 575 includes a first pin receiver 577 and a first biasing tab 578. The second biasing handle bracket 576 includes a second pin receiver 579 and a second biasing tab 580. It is contemplated that the biasing handle 572 may include a secondary tension assembly disposed on the inside wall of the first biasing handle 572. The first and second pin receiver 577 and 579, in a preferred embodiment, are configured as apertures through the first and second biasing handle bracket 575 and 576. The apertures enable the pin 558 to engage through the first and second biasing handle bracket 575 and 576, as shown in FIGS. 23 through 28, and couple the biasing handle 572 with the pin 558 which couples with the fastener member 552 which couples with the first and second tab 514 and 520 of the router assembly 500. Further, the pin 558 enables the biasing handle 572 to rotate relative to the router assembly 500. This provides for the operational engagement of the biasing assembly 550 and determines the engagement of the worm drive of the depth adjustment mechanism.

It is contemplated that the biasing handle 572 may be enabled to operationally couple with a securing mechanism. For example, a latch assembly may be disposed on the base 504 in a position which enables it to couple with the biasing handle 572 when it is engaging against the first and second brackets. Alternatively, a receiver may be disposed on the base 504 which may be engaged by the biasing handle 572. For example, the receiver may be a compression lock and the biasing handle 572 may be disposed with a compression clip which is located in a position to enable its engagement with the compression lock. A release mechanism may be coupled with the compression lock or included with the compression clip. For example, a push button may be included on the biasing handle 572 which is operational coupled with the compression clip and provides a release functionality when pushed.

The biasing assembly 550, disposed on the router assembly 500, further includes a second biasing handle 580. The second biasing handle 580 includes a first end 581 and a second end 582. The second end 582 may be operationally engaged by a user of the router assembly 500. The first end 581 couples with the second tab 520 using a first fastener 585 and a second fastener 586. The first and second fasteners insert through a first biasing fastening point 583 and a second biasing fastening point 584, to engage with a first fastening point 521 and a second fastening point 523 disposed on the second tab 520. The first and second fasteners operationally engage with the second biasing handle 580 and the second tab 520 to secure the position of the first end 581 of the second biasing handle 580. In the exemplary embodiment, the second biasing handle 580 further includes a tensioning assembly comprising a first tension bracket 588 and a second tension bracket 589. The first tension bracket 588 and the second tension bracket 589 operationally engage with the shaft member 532 of the handle 506, in operation. In a preferred embodiment, the first tension bracket 588 may engage against the first biasing receiver 535 and the second tension bracket 589 may engage against the second biasing receiver 536. It is contemplated that the tensioning assembly of the second biasing handle 580 may be variously configured as contemplated by those of ordinary skill in the art.

It is contemplated that the second biasing handle 580 may be enabled to operationally couple with a securing mechanism. For example, a latch assembly may be disposed on the base 504 in a position which enables it to couple with the second biasing handle 580 when it is engaging against the first and second brackets. Alternatively, a receiver may be disposed on the base 504 which may be engaged by the second biasing handle 580. For example, the receiver may be a compression lock and the second biasing handle 580 may be disposed with a compression clip which is located in a position to enable its engagement with the compression lock. A release mechanism may be coupled with the compression lock or included with the compression clip. For example, a push button may be included on the second biasing handle 580 which is operational coupled with the compression clip and provides a release functionality when pushed.

The biasing assembly 550 provides the force for engaging the shaft member 532 against the rack member 538. In the exemplary embodiment, the biasing assembly 550 accomplishes this through engagement of the first biasing handle 572 with the second biasing handle 580. In operation, the first biasing handle 572 and second biasing handle 580 may be manually engaged by an operator of the router assembly 500. The operator may rotate the first biasing handle 572 to establish the worm drive in an engaged or open position. The second biasing handle 580 may be enabled to rotate, however, in the current embodiment the second biasing handle 580 is secured in position by the first and second fasteners 585 and 586. It is contemplated that the first and second fasteners may enable a limited range of movement.

To establish the open position, the first biasing handle 572 is rotated away from the base 504. This rotation releases the force the first biasing handle 572 applies against the second biasing handle 580. Thus, the second biasing handle 580 is enabled to extend away from the first and second biasing receiver 535 and 536 of the handle 506. The rotation of the first biasing handle 572 further causes the first and second biasing tab 578 and 580 to engage against the first bracket 564 and second bracket 565, respectively This engagement causes the first and second bracket 564 and 565 to bias away from the shaft member 532. The second end 573 of the first bracket 564 and the second end 576 of the second bracket 565 engage with the first biasing receiver 535 and the second biasing receiver 536 of the shaft member 532. When the first and second biasing tabs of the biasing handle 572 engage with the first and second brackets, respectively, the second ends of the first and second brackets bias away from engagement with the biasing receivers and force the second biasing handle 580 away from the base 504.

To establish the engaged position, which enables the worm drive as a functional depth adjustment mechanism, the second biasing handle 580 and the first biasing handle 572 are rotated towards the base 504 into a closed position. The first biasing handle 572 is rotated to a closed position, which results in the first biasing handle 572 applying a force against the second biasing handle 580. This engagement biases the first and second biasing brackets 588 and 589 towards the base 504 and into engagement with the first and second biasing receiver 535 and 536, respectively, of the shaft member 532. The engagement of the first and second biasing bracket 588 and 589 with the first and second biasing receiver 535 and 536 imparts a force which results in the shaft member 532 meshing with the rack member 538 disposed on the motor casing assembly 502.

Figure 32:
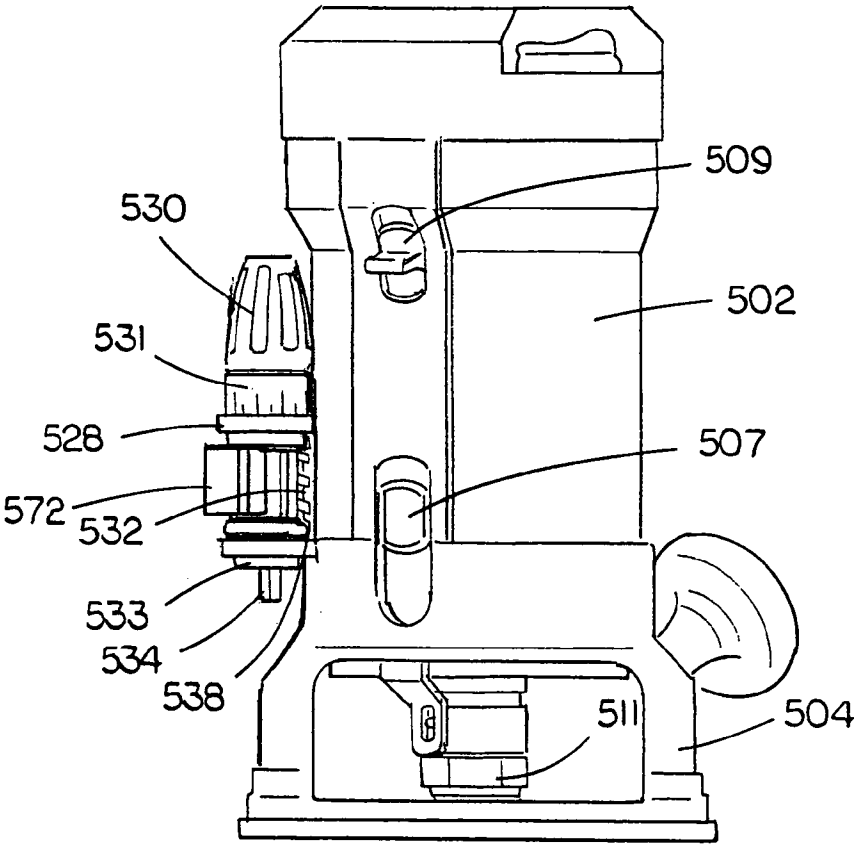
FIG. 32 is an illustration of the router assembly with the depth adjustment mechanism of FIG. 22 placing a bit engagement assembly in a lowered second position.
Figure 31:
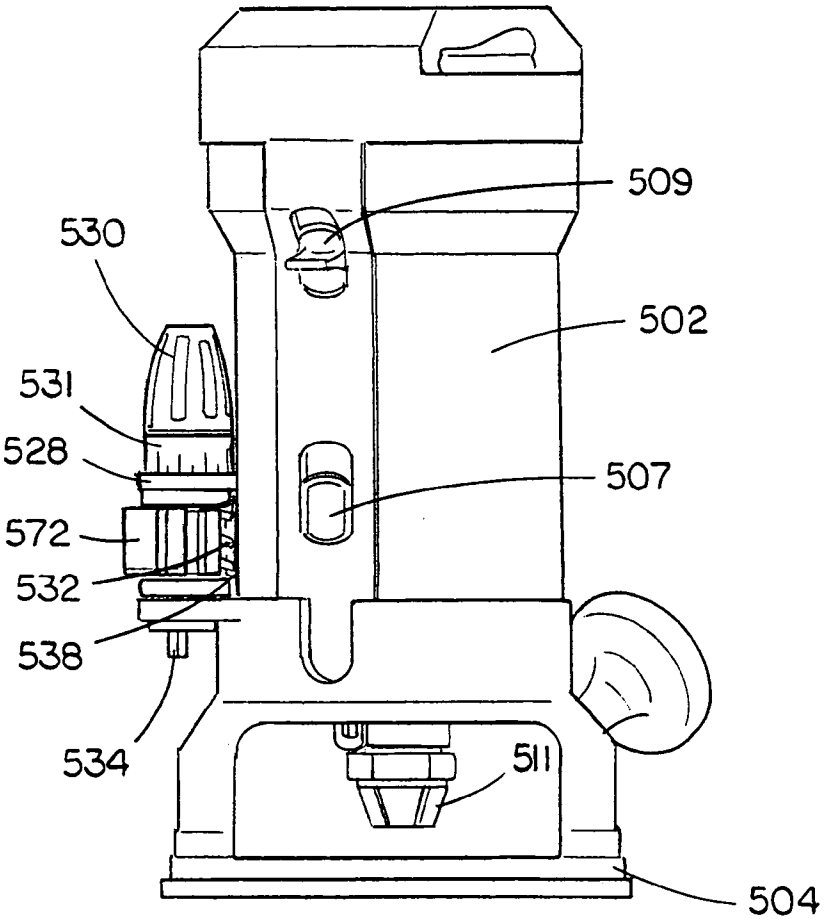
FIG. 31 is an illustration of the router assembly with the depth adjustment mechanism of FIG. 22 placing a bit engagement assembly in a raised first position.

FIGS. 31 and 32, show the router assembly 500 of the present invention with the worm drive assembly engaged placing the motor casing 502 in various positions relative to the base 504. In FIG. 31 the router assembly 500 is shown in a raised first position. This is exemplified by the appearance of the spindle and collet assembly 511 (router bit engagement assembly) above the base 504. It is understood that the shaft member 532 is engaged with the rack member 538 and may leave open threads of the rack member 538 above the threads of the shaft member 532. In FIG. 32 the router assembly 500 is in a lowered second position. This is exemplified by the spindle and collet assembly 511 being partially hidden from view by the base 504. In this position a bit is enabled to provide a deeper cut into a work piece than that provided if the bit was so engaged and the router assembly 500 was in the first raised position shown in FIG. 31. It is understood that the second lowered position of FIG. 32 may leave open threads of the rack member 538 below the threads of the shaft member 532.

Figure 33:
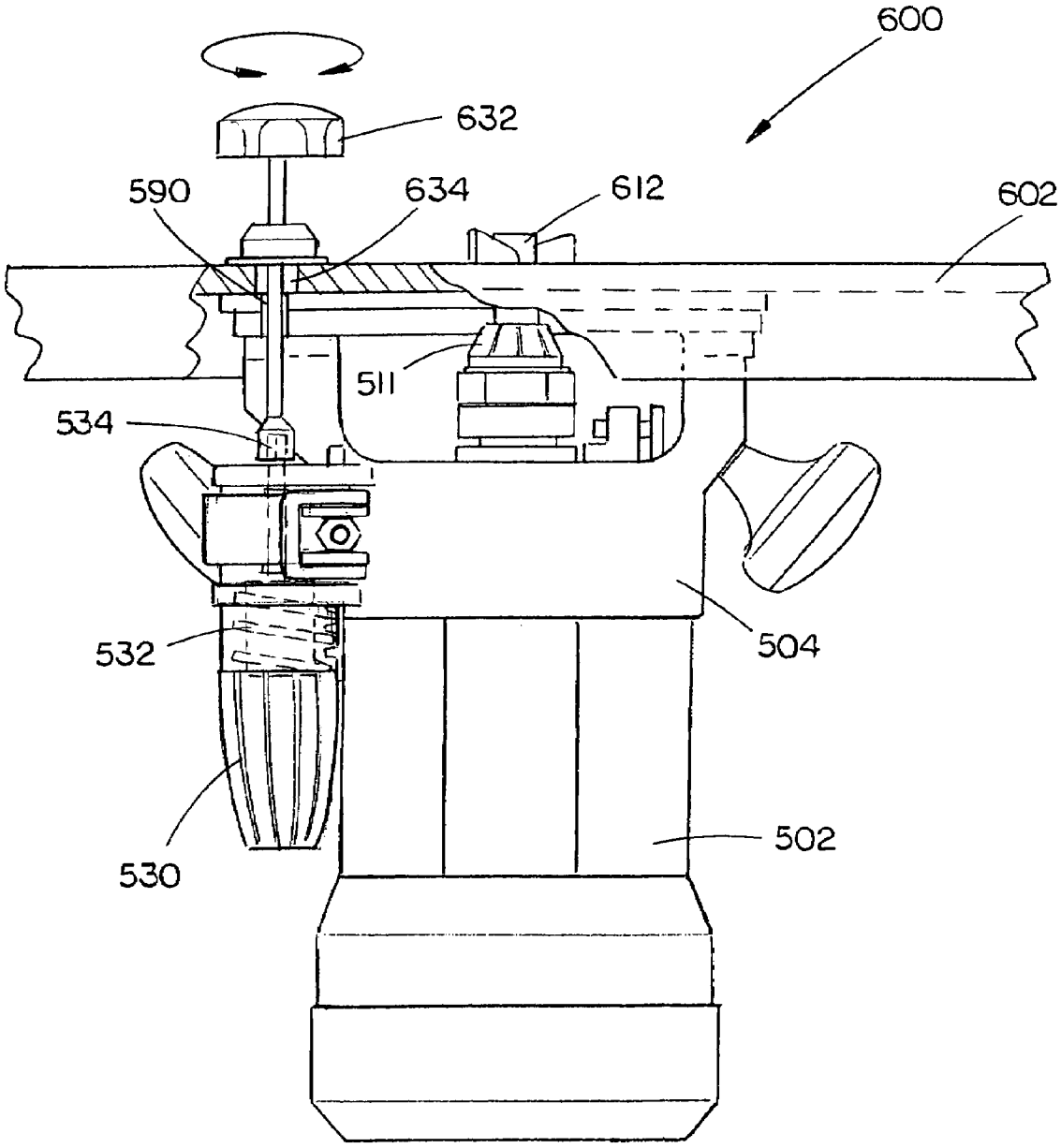
FIG. 33 is a side elevation view illustrating the router assembly of FIG. 22 engaged against a router table of a router table assembly, wherein the shaft member enables a mechanical connection with a coupling device for enabling depth adjustment by the depth adjustment mechanism.
Figure 34:
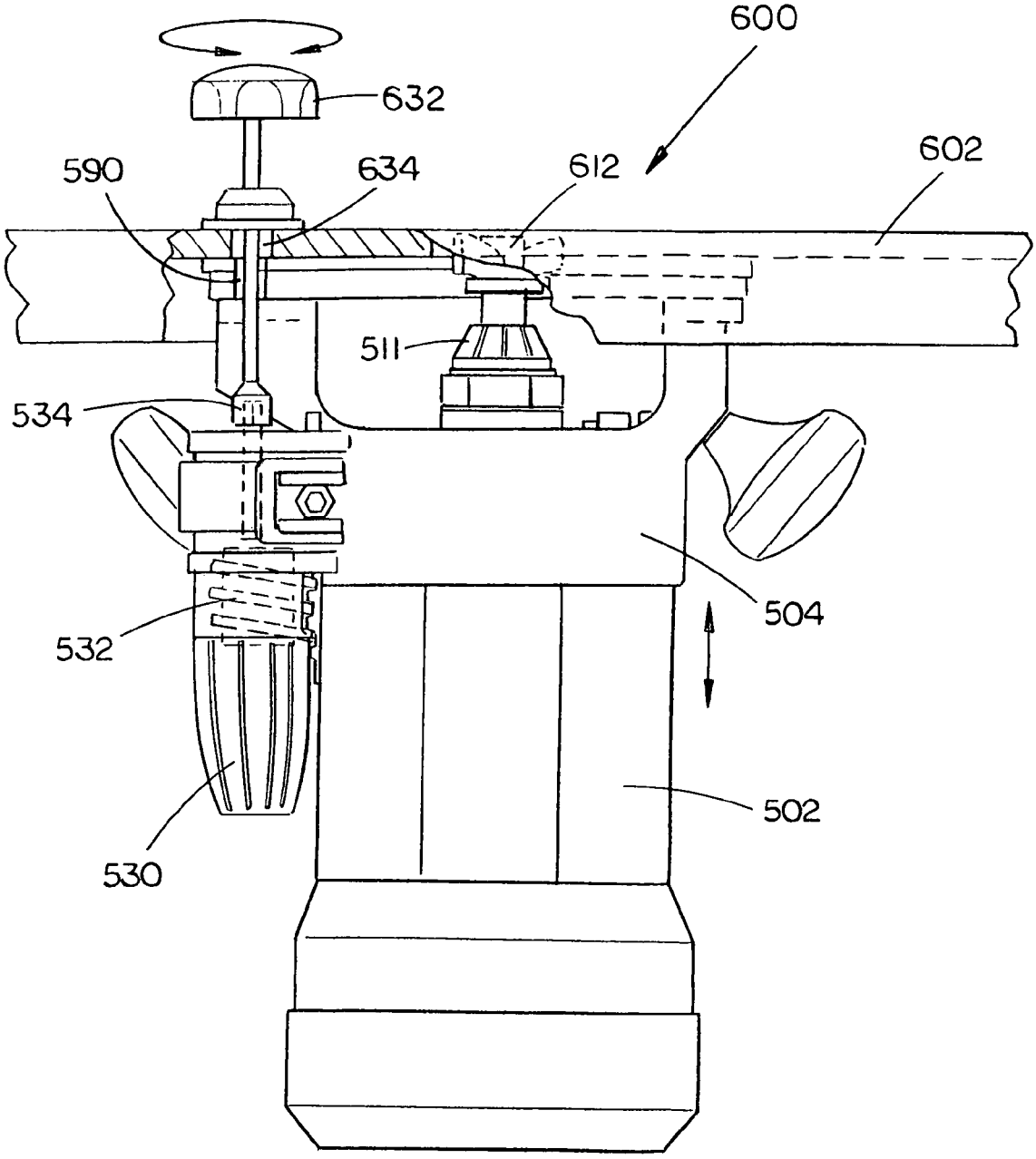
FIG. 34 is an expanded view of FIG. 33 illustrating the movement of the coupling device and the concomitant movement of the depth adjustment mechanism.

Referring now to FIGS. 33 and 34, a router table assembly 600 is shown. The router table assembly 600 includes a router table 602 coupled with the router assembly 500. Alternatively, the router table assembly 600 may operationally engage the router assembly 100, 200, 300 or 400. The router assembly 500 is comprised of the motor casing 502, at least partially encompassing the motor which couples with the spindle and collet assembly (bit engagement assembly) 511, coupled with the base 504. The depth adjustment mechanism engages via the sleeve 524 to provide its operational capabilities.

The mechanical connection 534 may be accessed by a tool 632. The tool 632 may be a variety of devices, such as an allen wrench, a screw driver, socket wrench, and the like. The mechanical connection 534 may be rotated by the tool 632 which in turn rotates the spirally threaded shaft 532, which if engaged with the rack member 538, causes the motor casing 502 to move relative to the base 504. Access of the tool 632 to the mechanical connection 534 is provided by a base access point 590 (i.e., an aperture) defined in the base 504 and a table access point 634 (i.e., a second aperture) defined in the router table 602. In this way an operator of the router table assembly 600 may make depth adjustments of the bit 612 without having to remove the router assembly 500 from the router table 602. FIG. 34 is an expanded view of the router table assembly 600. Additionally, it is seen that rotation of the tool 632 may occur in either direction, which causes the spirally threaded shaft 632 to turn in either direction. The direction of rotation of the tool 632 causes a concomitant raising or lowering of the bit 612 relative to the router table 602.

It is understood that various features of the present invention may be modified to promote the effectiveness of providing the continuous metered depth adjustment capability. For example, the configuration of the handles and housings 108, 206, 306, 406, and 506 may vary to promote efficient use and user comfort. The handles and housings may be increased or decreased in length and/or width. For instance, the handle/housing may be extended above the motor casing. Further, the user engaged rotator members may be enlarged or reduced in size. Various grip contouring and materials may be employed to promote comfort and ease of use. The micro adjust collars may be re-configured to include larger markings to promote easier visual ascertainment of the indicators on the collars. There may be a concomitant increase or reduction in the size of the shaft members and rack members to correspond with any configuration changes made in other features of the handles/housings.

It is contemplated that the sleeves which receive the handles/housings may be similarly re-configured to enable the operational functionality of the depth adjustment assemblies and router assemblies of the present invention. Additionally, the sleeves may promote the functionality of the depth adjustment mechanism by having a shaft member disposed within. Thus, a user may engage the rotator member and micro adjust collar, and/or housing with the shaft member. The user may then disengage from the shaft member and remove the other component features. This may promote the prevention of damage to the depth adjustment mechanism. It is further contemplated that the sleeves may be removed from the bases through the use of mechanisms which allow the sleeves to securely connect with the bases and then be removed. This may be accomplished by various mechanisms, such as a compression lock system and the like. The sleeve may be integrated with the handles/housings becoming a single unit of component features. Thus, the sleeve and the other component features may be removed entirely from the router assembly. This may be advantageous in promoting the prevention of damage to these component features and the sleeve. Further, it may provide an aesthetic appeal to users who may wish to employ the depth adjusting capabilities of the present invention on a temporary basis and wish to be able to remove the features when they are not be employed.

The mechanical connectors 117, 217, 317, 434, and 534 may promote adjustments of the depth of a router bit coupled with the router assembly 100, 200, 300, 400, and 500, respectively. This may be accomplished through engagement with the mechanical connectors. In a preferred embodiments, the mechanical connectors are generally configured in a hexagonal rod form and disposed on the end of the shaft members of the router assemblies 100 through 500. The user of the present invention may engage a wrench against the hex rods and through rotation of the hex rods cause the shaft members to rotate. The rotation of the sprially threaded shaft members causes its displacement along the length of the threaded members. Therefore, depending on the direction of rotation of the hex rods the sprially threaded shaft members may be moved up the rack members or down the rack members. When the shaft members are displaced up their rack members, the motor casings are displaced vertically away from the base's with which they are adjustably coupled. This has the effect of raising the router bit vertically which results in a shallower depth of cut provided when employing the router assembly. When the shaft members are displaced down their rack members, the motor casings are displaced vertically down into the base's with which they are adjustably coupled. This has the effect of lowering the router bit vertically which results in a deeper depth of cut provided when employing the router assembly. It is understood that alternate depth adjustment systems may be employed without departing from the scope and spirit of the present invention. For example, a ratchet system or latch system may be employed to enable the continuous metered adjustment capability of the present invention.

In alternative embodiments, the mechanical connectors may be variously configured. For example, the mechanical connectors may be a hex head, so that the mechanical connectors, of the shaft members, are accessible and may be engaged by a hand tool, i.e., an open end box wrench or the like.

It is further understood that the biasing handles 320, 482, 572, and 580 may be configured in various alternative manners. The handles may be extended or shortened in length. The handles may include grip regions which may include contoured surfacing and or grips to promote user comfort. The handles 320, 482, and 572 may include biasing brackets to promote effective engagement of the shaft members with the rack members. The biasing brackets, including those disposed on the second biasing handle 580, may be variously configured as contemplated by those of ordinary skill in the art.

The first and second brackets 474 and 475 and the first and second brackets 564 and 565 are optimally configured to promote the operation of the worm drive. It is contemplated that these brackets may include various design modifications to further promote their functionality. For example, the second ends of these brackets may include a secondary tension mechanism which provides additional force for the operational engagement of the components of the worm drive. The brackets may be extended or shortened in length to accommodate the needs of users and manufacturers.

It is understood that the rack member 114, 214, 314, 438, and 538 may be variously alternatively configured to enable the functionality of the present invention. For example, the rack members may be integral with the motor casings, secured in place via a welding process, adhering process, molding process, and the like. In a still further embodiment, it is contemplated that the rack members may be established as a series of slots within the motor casings. The slots being configured for engagement by the shaft member of the worm drive assembly. Thus, the motor casings may be established with a necessary feature for enabling the worm drive assemblies of the depth adjustment mechanisms of the present invention.

In the previous exemplary embodiments, of FIGS. 1 through 34, the handle 108, 206, 306, 406, and 506 of the present invention has been described as comprising various component features. These various component features have been functionally established in relation with one another to enable the capabilities of the present invention. It is contemplated that the various component features of the handle may be configured and coupled with one another in a variety of ways. For instance, the shaft members may be established as multiple pieces coupled together. For example, the shaft members may include a shaft which is coupled with a threaded member and a mechanical connector. This three piece arrangement may provide similar functional capabilities for the depth adjustment mechanisms, as described throughout the instant specification. It is understood that the mechanical connector may not be required to provide the worm drive functionality of the depth adjustment mechanism.

The sleeves established for the exemplary embodiments described herein in reference to FIGS. 1 through 34, may be variously configured to accommodate differently configured handles. For example, when the handle includes a shaft, as described above, the sleeve may be established as a housing with a first and second end with each end including a receiving point (i.e., aperture) through the end for the shaft to be inserted through. In this embodiment, the threaded member may be disposed between the first and second ends and at least partially encompassed by the housing. Alternatively, the sleeve may be established with a first and second rib, as shown in FIGS. 17 through 34. The ribs may be generally configured as disks with a receiver. The receiver may be an aperture which extends through the disk allowing the shaft to be inserted through the receiver and the disk.

It is further contemplated that the sleeves may enable the handle and/or various components which comprise the handle to be adjusted relative to the sleeve and the motor casing. For example, the sleeve may include a spring assembly which engages against the handle providing a force against the handle. The spring assembly may assist in promoting the engagement of the shaft member with the rack member. Further, the user may bias the spring assembly, thereby, moving the shaft member away from engagement with the rack member. The amount of movement enabled by the spring assembly may vary to accommodate different needs. It is understood that the adjustment capabilities provided via the sleeve may be enabled using various mechanisms as contemplated by those of ordinary skill in the art.

In an alternative embodiment, the sleeve may be enabled with adjustment capabilities relative to the base and motor casing of the router assembly. This adjustment capability may be enabled using various mechanisms, such as a spring-loaded mechanism, latch mechanism, compression mechanism, and the like. The adjustment may result in the sleeve be biased away from the base and motor casing when the depth adjustment mechanism is not in use and biased towards the base and motor casing when the depth adjustment mechanism is to be used. This adjustment capability may enable the sleeve to pivot relative to the base and motor casing. This may enable the handle, when inserted within the sleeve, to disengage the shaft member from the rack member. This disengagement may be a partial or full disengagement and may allow for partial depth adjustment capabilities and the removal of the handle from within the sleeve. It is contemplated that the sleeve may also be enabled to rotate away from the base and motor casing of the router assembly. The rotation enabling the user to further determine the operation of the depth adjustment mechanism, as previously described. The positioning of the sleeve relative to the base and motor casing may be enabled in plural. Thus, the sleeve may provide user selectable positions for the sleeve, which may accommodate varying needs of different users.

The first and second brackets 474 and 475 of the exemplary embodiment shown in FIGS. 16 through 21, and first and second brackets 564 and 565 of the exemplary embodiment shown in FIGS. 22 through 34, may be variously configured. For instance, with the handle configured as a multiple piece assembly including a shaft, the brackets may include a shaft receiver for engaging with the shaft. The shaft receivers may be apertures through the brackets, through which the shaft may be inserted.

FIGS. 15A, 15B, and 15C illustrate an exemplary embodiment, of the router assembly 300, for establishing the depth adjustment mechanism in various positions, i.e., fully engaged, partially engaged, and fully disengaged. It is contemplated that the other exemplary embodiments of the router assembly 100, 200, 400, and 500 may be similarly enabled to establish the depth adjustment mechanisms in various positions. Further, other systems may be employed to enable the positioning functionality, described in FIGS. 15A through 15C, for the router assembly 100, 200, 300, 400, and 500, such as a friction fit system, compression system, and the like. Alternatively, the positioning functionality enabled for the router assemblies of the present invention may be enabled to establish different positioning capabilities than those described. For instance, the depth adjustment mechanism may only be able to be established in a first fully disengaged position and a second fully engaged position. In another instance, the depth adjustment mechanism may provide for four or more positions to be established in enabling the functionality of the present invention.

It is further contemplated that a handle extension member may be coupled with the handle 108, 206, 306, 406, and 506, of the present invention. The handle extension member may provide a grasping region for the user of the router assembly employing the depth adjustment mechanism of the present invention, which is extended from the handle. The extension may be a relatively planar extended member of may be established in various angles relative to the handle. The handle extension member may be removed from the handle or be integral with the handle. The handle extension member may be pivotally coupled with the handle in order to adjust the relative orientation of the handle extension member with respect to the handle and other components of the router assembly.

Figure 35:
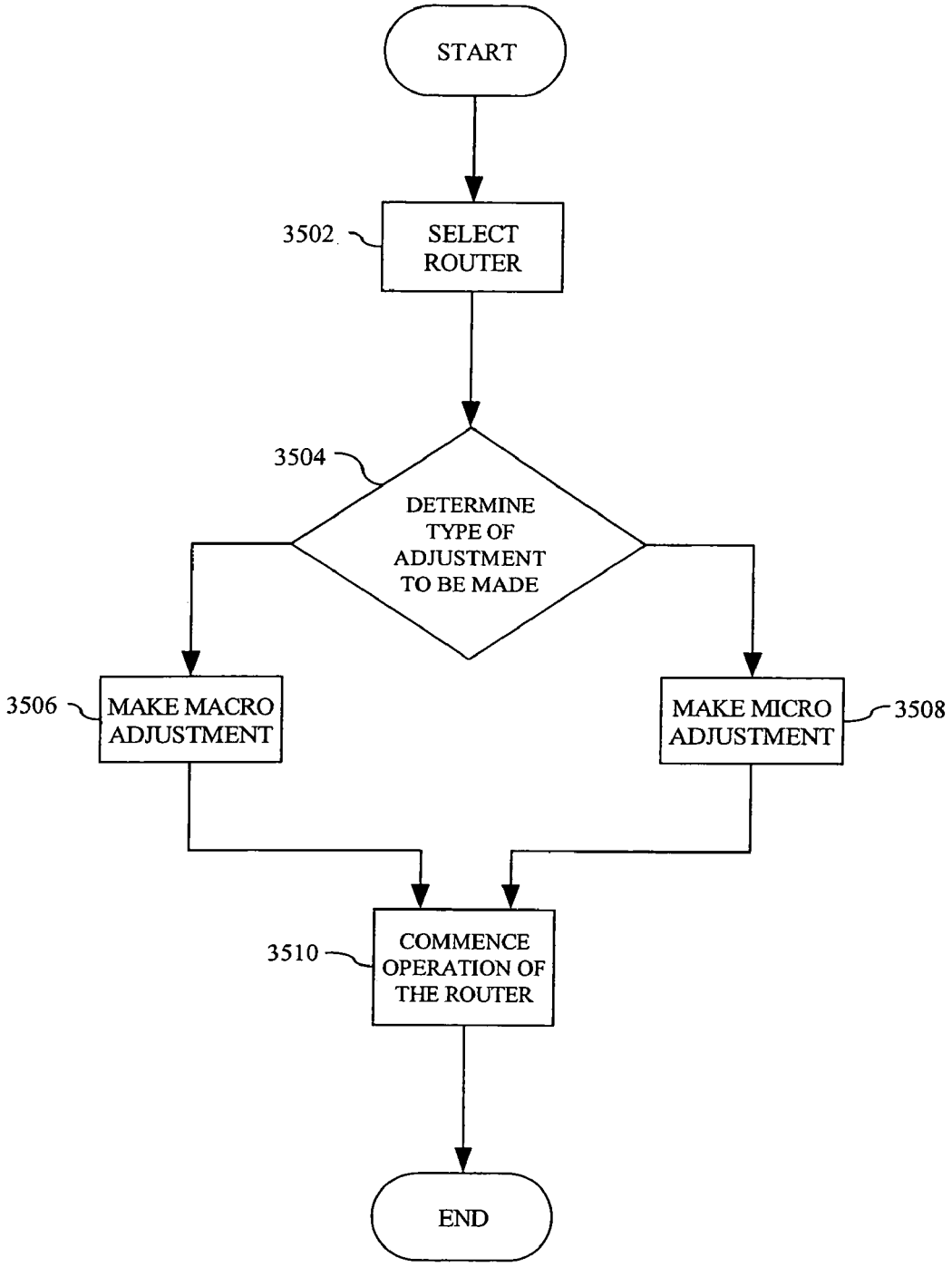
FIG. 35 illustrates a block diagram representing a method of providing continuous metered depth adjustments of a router bit.

A method of providing continuous metered depth adjustment capabilities to a router, for the adjustment of a router bit, is shown in FIG. 35. The user in step 3502 first selects a router assembly which is enabled with the depth adjustment mechanism of the present invention. Then the user in step 3504 determines the type of depth adjustment they wish to make. The user may select to make a macro adjustment and then proceed to step 3506 where the user dis-engages the depth adjustment mechanism in order to manually adjust the position of the motor casing relative to the base. Alternatively, the user may select to make a micro adjustment and then proceed to step 3508. In step 3508 the user engages the depth adjustment mechanism and through rotational movement of the shaft member engaged against the rack member, the depth of the cut to be established by the router bit is determined. After the user has established the functional position of the router in step 3506 or 3508 then, in step 3510 the user may proceed with commencing the operation of the router.

it is understood that the specific order or hierarchy of steps in the method disclosed are examples of exemplary approaches. Based upon design preferences, it is understood that the specific order or hierarchy of steps in the method can be rearranged while remaining within the scope and spirit of the present invention. The accompanying method claim presents elements of the various steps in a sample order, and are not necessarily meant to be limited to the specific order or hierarchy presented.

It is believed that the present invention and many of its attendant advantages will be understood by the forgoing description. It is also believed that it will be apparent that various changes may be made in the form, construction and arrangement of the components thereof without departing from the scope and spirit of the invention or without sacrificing all of its material advantages. The form herein before described being merely an explanatory embodiment thereof. It is the intention of the following claims to encompass and include such changes.

What is claimed is:

1. A depth adjustment mechanism for a power tool having a motor casing adjustably received in a base, the depth adjustment mechanism comprising:

a rotation member;

a threaded shaft member coupled with the rotation member, and being received within a sleeve coupled to the base;

a rack member coupled with the casing, the rack member being selectively engaged by the threaded shaft member; and a biasing assembly including a clamp with an arm that clamps over at least one of the threaded shaft member and the rack member to enable selective engagement of the threaded shaft member with the rack member, wherein the threaded shaft member and the rack member, when engaged, enable depth adjustment of the motor casing relative to the base.

2. The depth adjustment mechanism of claim 1, wherein the threaded shaft member is a spirally threaded shaft member which is removable from the sleeve.

3. The depth adjustment mechanism of claim 1, fhrther comprising a micro adjust collar.

4. The depth adjustment mechanism of claim 1, wherein the biasing assembly comprises a biasing handle adjustably coupled wiht the sleeve.

5. The depth adjustment mechanism of claim 4, wherein the biasing handle is adjustably coupled with the base.

6. The dept adjustment mechanism of claim 1, wherein the biasing assembly comprises a first biasing handle and a second biasing handle.

7. The depth adjustment mechanism of claim 1, wherein the sleeve includes a fastening assembly.

8. The depth adjustment mechanism of claim 1, wherein the sleeve comprises a first rib and a second rib.

9. A router assembly, comprising:

a motor casing coupled with a base; and a depth adjustment mechanism enabling adjustment of the motor casing relative to the base along an axis, wherein the depth adjustment mechanism comprises a rotation member rotatably coupled to the base and movable axially relative to the casing, an engaging member coupled to the casing and movable axially relative to the base;

a biasing assembly including a clamp with an arm that clamps over at least one of the rotation member and the engaging member and that enables selective engagement of the rotation member with the engaging member to enable adjustment of the motor casing relative to the base along the axis.

10. The router assembly of claim 9, wherein the motor casing is removable from the base.

11. The router assembly of claim 9, wherein the rotation member, is removable from the base.

12. The router assembly of claim 9, further comprising a micro adjust collar.

13. The router assembly of claim 9, wherein the base includes a fastening assembly.

14. The router assembly of claim 9, wherein the base comprises a first rib and a second rib.

15. A router table assembly, comprising:

a router table;

a router assembly coupled with the router table, wherein the router assembly comprises:

a motor casing adjustably coupled with a base; and a depth adjustment mechanism providing adjustment of the motor casing relative to the base along an axis, wherein the depth adjustment mechanism comprises a rotation member rotatably coupled to the base and movable axially relative to the casing, an engaging member coupled to the casing and movable axially relative to the base, and a biasing assembly including a clamp with an arm that clamps over at least one of the rotation member and the engaging member and that enables selective engagement of the rotation member with the engaging member to enable adjustment of the motor casing relative to the base along the axis.

16. The router table assembly of claim 15, wherein the motor casing is removable from the base.

17. The router table assembly of claim 15, wherein the rotation member, is removable from the base.

18. The router table assembly of claim 15, further comprising a micro adjust collar.

19. The router table assembly of claim 15, wherein the base includes a fastening assembly.

20. The router table assembly of claim 15, wherein the base comprises a first rib and a second rib.

21. The depth adjustment mechanism of claim 1 wherein the rotation member is movable axially relative to the casing.

22. The depth adjustment mechanism of claim 1 wherein the rack member is movable axially relative to the base.

23. The depth adjustment mechanism of claim 1 wherein the rotation member is coupled to the base so as not to move axially relative to the base.

24. The depth adjustment mechanism of claim 1 wherein the thread engaging member is coupled to the casing so as not to move axially relative to the casing.

25. The router assembly of claim 9 wherein the rotation member comprises a threaded portion that is engageable with the engaging member.

26. The router assembly of claim 25 wherein the engaging member comprises a rack that is engageable with the threaded portion.

27. The router table assembly of claim 15 wherein the rotation member comprises a threaded portion that is engageable with the engaging member.

28. The router table assembly of claim 27 wherein the engaging member comprises a rack that is engageable with the threaded portion.

29. A depth adjustment mechanism for a power tool having a motor casing movably received in a base for depth adjustment, the depth adjustment mechanism comprising:

a rotation member rotatably coupled to the base and movable axially relative to the casing, an engaging member coupled to the casing and movable axially relative to the base;

a biasing assembly including a clamp with an arm that clamps over at least one of the rotation member and the engaging member and that enables selective engagement of the rotation member with the engaging member to enable the adjustment of the motor casing relative to the base.

30. The depth adjustment mechanism of claim 29 wherein the rotation member comprises a threaded portion that is engageable with the engaging member.

31. The depth adjustment mechanism of claim 30 wherein the engaging member comprises a rack that is engageable with the threaded portion.

32. The depth adjustment mechanism of claim 29 wherein the rotation member is coupled to the base so as not to move axially relative to the base.

33. The depth adjustment mechanism of claim 29 wherein the thread engaging member is coupled to the casing so as not to move axially relative to the casing.

* * * * *